US005241347A

United States Patent [19]

Kodama

[11] Patent Number: 5,241,347

[45] Date of Patent: Aug. 31, 1993

[54] IMAGE FORMING APPARATUS COMPRISING MEANS FOR AUTOMATICALLY ADJUSTING IMAGE DENSITY

[75] Inventor: Hideaki Kodama, Okazaki, Japan

[73] Assignee: Minolta Camera Kabushiki Kaisha, Osaka, Japan

[21] Appl. No.: 799,295

[22] Filed: Nov. 27, 1991

[30] Foreign Application Priority Data

Nov. 29, 1990 [JP] Japan ..... 2-335845

[51] Int. Cl.[5] ..... G03G 21/00

[52] U.S. Cl. ..... 355/246; 346/160; 355/208

[58] Field of Search ..... 355/246, 245, 203, 204, 355/208, 206, 209; 346/160

[56] References Cited

U.S. PATENT DOCUMENTS

| | | | |
|---|---|---|---|
| 4,624,547 | 11/1986 | Endo et al. | 355/208 |
| 4,627,712 | 12/1986 | Usami | 355/206 |
| 4,693,592 | 9/1987 | Kurpan | 355/208 |
| 4,733,276 | 3/1988 | Kakitani | 355/246 X |
| 4,829,336 | 5/1989 | Champion et al. | 355/246 |
| 4,833,506 | 5/1989 | Kuru et al. | 355/208 |
| 4,853,738 | 8/1989 | Rushing | 355/327 |
| 4,873,428 | 10/1989 | Takeuchi et al. | 250/214 DC |
| 4,959,669 | 9/1990 | Haneda et al. | 346/157 |
| 5,012,286 | 4/1991 | Kawano et al. | 355/246 |
| 5,045,883 | 9/1991 | Ishigaki et al. | 355/246 X |

*Primary Examiner*—A. T. Grimley
*Assistant Examiner*—Sandra L. Brasé
*Attorney, Agent, or Firm*—Burns, Doane, Swecker & Mathis

[57] ABSTRACT

In an image forming apparatus for forming an image on a sheet of paper, including an image forming device for forming a reference toner image having a predetermined density on an image retaining member. A first detector detects a density of the reference toner image formed on the image retaining member and outputs first density data for representing the detected density thereof, and then, the reference toner image formed on the image retaining member is transferred onto a sheet of paper. On the other hand, a second detector detects a density of the reference toner image transferred on the sheet of paper and outputs second density data for representing the detected density thereof. Further, a controller automatically adjusts an image density of an image formed on a sheet of paper so as to obtain a predetermined image density by controlling operation conditions of the image forming device based on the first and second density data respectively outputted from the first and second detectors.

9 Claims, 30 Drawing Sheets

IMAGE FORMING APPARATUS COMPRISING MEANS FOR AUTOMATICALLY ADJUSTING IMAGE DENSITY

BACKGROUND OF THE INVENTION

1. Field of the Invention

The present invention relates to an image forming apparatus, and more particularly, to an image forming apparatus using an electrophotographic process such as an image forming apparatus provided in a digital full color copying machine using an electrophotographic process, comprising means for automatically adjusting an image density of an image to be reproduced so as to obtain a desirable proper image density thereof.

2. Description of the Related Art

Conventionally, there have been put into practical use various kinds of electrophotographic image forming apparatuses such as a laser printer for driving a laser diode based on digital image data of an image of an original and reproducing the image of the original on a sheet of printing paper. Further, there have been proposed various kinds of digital image forming methods for faithfully reproducing a half-tone image such as a photograph.

As the digital image forming methods of these type, there have been known to those skilled in the art, an area gradation method using a dither matrix, and multi-value laser exposure methods such as a pulse width modulation method for representing a gradation of one dot image to be printed by changing a pulse width or an emitting time of a beam of laser light so as to change a light amount thereof defined as a product of the emitting time and an emitting intensity, and an intensity modulation method for representing a gradation of one dot image to be printed by changing an emitting intensity of a beam of laser light so as to change a light amount thereof (See Japanese Patent Laid-open Publication Nos. 62-91077, 62-39972, 62-188562 and 61-22597). Further, there has been publicly known a multi-value dither method which is a combination of the dither method and the above-mentioned pulse width modulation method or the above-mentioned intensity modulation method.

In the gradation method of this type for representing a gradation, it is considered possible in principle to reproduce an image density having a gradation strictly corresponding to a gradation of image data to be reproduced, however, an original density to be reproduced is not correctly proportional to an actually reproduced image density (referred to as an image density hereinafter) because of a complicated combination of characteristics of a photoconductor and toners and circumstances etc. In other words, a relationship between the image density and the original density shows a characteristic curve B which is shifted from a characteristic curve A to be originally obtained, as schematically shown in FIG. 4. Such characteristic as above is generally called a $\gamma$ characteristic, which mainly causes deterioration of faithfulness of reproduced images of originals, particularly of a half-tone original.

Therefore, in order to improve faithfulness of a reproduced image, conventionally, there has been performed a so-called $\gamma$ correction process for converting data of a read original density into data using a predetermined $\gamma$ correction table and forming a digital image of dot images based on the converted data of the original density so that the relationship between the original density and the image density becomes linear, namely, the above-mentioned linear characteristic A shown in FIG. 4 can be obtained. Thus, normally, the image of the original can be faithfully reproduced depending on the original density by performing the above-mentioned the $\gamma$ correction process.

On the other hand, as one of phenomena due to another cause for influencing the image density, there is such a phenomenon that an adhering amount of toner onto the photoconductor changes upon a developing process using the toner when characteristics of the photoconductor and the toner changes due to change in external circumstances such as the temperature, the humidity, etc. Generally speaking, the adhering amount of toner increases under circumstances of a high temperature and a high humidity so that the original image having a higher image density is reproduced with a $\gamma$ characteristic having a relatively large gradient in a relatively high original density. On the other hand, the adhering amount of toner decreases under circumstances of a low temperature and a low humidity so that the original image having a lower image density is reproduced with a $\gamma$ characteristic having a relatively small gradient in relatively low and middle original densities.

Thus, there is such a problem that the reproduced image density changes due to change in the circumstances. In order to solve the above-mentioned problem so as to obtain a stable proper image density, there has been performed an image density control process for controlling the maximum image density to be constant, generally, in a conventional electrophotographic copying machine, a conventional electrophotographic printer, or the like.

One of the above-mentioned image density control processes which has been put into practical use will be described below with reference to FIG. 5 for illustrating an image forming part comprising a photoconductive drum 41 and a developing roller 45*r*.

Referring to FIG. 5, a corona charger 43 having a discharging electric potential $V_C$ is provided so as to confront a photoconductive drum 41. A grid voltage $V_G$ is applied to a grid of the corona charger 43 by a grid voltage $V_G$ generator 214. An electric potential Vo on the surface of the photoconductive drum 41 is controlled by changing the grid voltage $V_C$ based on the electric potential Vo detected by a Vo sensor 44.

In the first place, prior to an exposure of a beam of laser light, a negative surface electric potential Vo is applied to the photoconductive drum 41 by the corona charger 43, and a negative developing bias voltage $V_B$ ($|Vo| > |V_B|$) of a relatively low electric potential is applied to the developing roller 45*r* by a developing bias voltage $V_B$ generator 215 in order to prevent a fog. In this case, the surface electric potential of a developing sleeve of the developing device is also set to the developing bias voltage $V_B$.

The surface electric potential Vo of the photoconductive drum 41 changes upon an exposure of a beam of laser light (referred to as a light exposure hereinafter) into an electrostatic latent image electric potential $V_I$ upon the light exposure with the maximum light amount of the laser light. When the electrostatic latent image electric potential $V_L$ becomes lower than the developing bias voltage $V_B$, the toner adheres onto the photoconductive drum 41. The adhering amount of toner increases as a difference between the developing bias voltage $V_B$ and electrostatic latent image electric potential $V_L$ becomes larger. Therefore, since the difference between the developing bias voltage $V_B$ and electrostatic latent image electric potential $V_L$ is changed by changing the surface electric potential Vo on the photoconductive drum 41 and the developing bias voltage $V_B$, the adhering amount of toner onto the photoconductive drum 41 can be changed, thereby eventually controlling the image density of the toner image.

According to the image density control process of this type as described above, the maximum image density is made constant by automatically or manually by an operator's changing the surface electric potential Vo on the photoconductive drum 41 and/or the developing bias voltage $V_B$.

In the automatic image density control process, a reference toner image of a reference image pattern which becomes a reference for the image density control process is formed on the surface of the photoconductive drum 41, and a light amount of a reflected light from the reference toner image is detected by an automatic image density controlling sensor (referred to as an AIDC sensor hereinafter) 203 provided in the vicinity of the photoconductive drum 41. Data of the detection value detected by the AIDC sensor 203 are inputted to a printer controller 201, which in turn controls the grid voltage $V_G$ generator 214 and the developing bias voltage $V_B$ generator 215 in accordance with a comparison result between the data of the detection value detected by the AIDC sensor 203 and a predetermined value. The above-mentioned process is repeated until the adhering amount of toner becomes the predetermined value.

However, even through the image density control process is performed so as to make the image density constant on the basis of the output of the AIDC sensor 203, a relationship between the output of the AIDC sensor 203 and the actual image density of the reference toner image changes due to change in characteristics of the AIDC sensor 203 and the circumstances from those in the initial state when the digital full color copying machine is manufactured. Therefore, the automatic image density control process can not be stably performed.

SUMMARY OF THE INVENTION

The object of the present invention is therefore to provide an image forming apparatus using an electrophotographic process, capable of automatically adjusting an image density of an image to be produced so as to reproducing the image having a proper image density even though a relationship between the output of the AIDC sensor 203 and the image density changes from that in an initial state when shipping the image forming apparatus from the factory for manufacturing it.

In order to achieve the aforementioned objective, according to the aspect of the present invention, there is provided an image forming apparatus for forming an image on a sheet of paper, comprising:

an image retaining member;

image forming means for forming a reference toner image having a predetermined density on said image retaining member;

first detection means for detecting a density of said reference toner image formed on said image retaining member and outputting first density data for representing the detected density thereof;

transfer means for transferring said reference toner image formed on said image retaining member onto a sheet of paper;

second detection means for detecting a density of said reference toner image transferred on said sheet of paper and outputting second density data for representing the detected density thereof; and adjustment means for automatically adjusting an image density of an image formed on a sheet of paper so as to obtain a predetermined image density by controlling operation conditions of said image forming apparatus based on said first and second density data respectively outputted from said first and second detection means.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
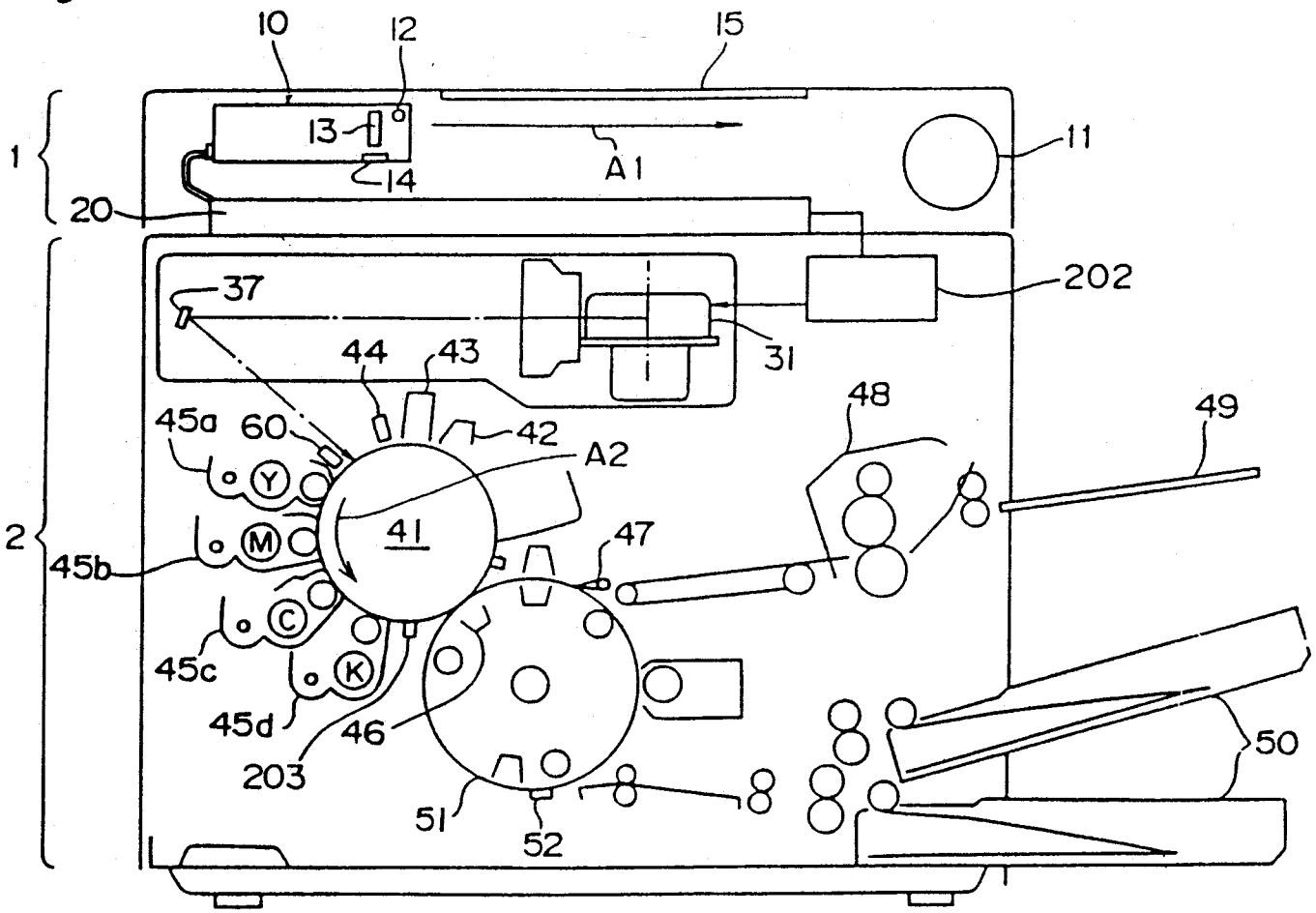
FIG. 1 is a longitudinal cross sectional view of a digital full color copying machine according to one embodiment of the present invention.

A digital full color copying machine according to one preferred embodiment of the present invention will be depicted hereinbelow with reference to the accompanying drawing in an order of the following items.

(a) Structure of Digital full color copying machine
(b) Processing of Image signal
(c) Image density control process
(d) Control flow of Printer controller The features of the digital full color copying machine of the present preferred embodiment are as follows. After there is read an image of a sample sheet 300 on which there have been formed reference test pattern images of respective colors of cyan C, magenta M, yellow Y and black K having the maximum image density in the initial state of the copying machine immediately before shipping it from a factory after manufacturing it (referred to as an initial state hereinafter) and toner images of the respective colors corresponding to the reference test pattern images are then formed on the photoconductive drum 41, light amounts of reflected lights from the toner images formed on the photoconductive drum 41 are measured by the AIDC sensor 203, and then, data of the light amounts thereof are stored in a RAM 232 as initial AIDC data. Further, the printed sample sheet 300 is read by a CCD image sensor 14, and read density data DDm of the respective reference test pattern images formed on the sample sheet 300 are stored in a RAM 17 as initial read density data. Thereafter, an image density control process is carried out in a manner as will be described below on the basis of the initial AIDC data stored in the RAM 232, the initial read density data stored in the RAM 17, and an output voltage Vs of the AIDC sensor 203 when the operator turns on an AIDC correction switch 241 (referred to as an AIDC-CPSW in the drawings).

When the relationship between the original density and the image density is shifted from that in the initial state as a result of deterioration of developers of developing devices 45*a* to 45*d*, change in a sensitivity of the photoconductive drum 41 or change in the circumstances, a relationship among the output voltage Vs of the AIDC sensor 203, the grid voltage $V_G$ of the corona charger 43 and the developing bias voltage $V_B$ is shifted from that in the initial state. Therefore, the output voltage Vs of the AIDC sensor 203 to be shifted at this time is calculated, the grid voltage $V_G$ and the developing bias voltage $V_B$ in a $V_G$ and $V_B$ table for representing a relationship among the output voltage Vs of the AIDC sensor 203, the grid voltage $V_G$ and the developing bias voltage $V_B$ are so as to be shifted based on the calculated output voltage Vs.

Thereafter, upon performing a normal copying process, the copying process is performed by selecting a suitable one of plural $\gamma$ correction tables on the basis of the corrected $V_G$ and $V_B$ table. In this case, the above-mentioned image density control process is performed so as to make the maximum image density of an image formed on a sheet of copying paper constant, thereby always forming a reproduced image having a constant gradation reproducibility for an original.

Furthermore, when one or more of the developing devices 45*a* to 45*d* are exchanged with new ones after the grid voltage $V_G$ and the developing bias voltage $V_B$ in the $V_G$ and $V_B$ table are set so as to be shifted as described above, the $V_G$ and $V_B$ table is initialized. More specifically, set values of the grid voltage $V_G$ and the developing bias voltage $V_B$ in the $V_G$ and $V_B$ table corresponding to the output voltage Vs are respectively shifted based on the shifted output voltage Vs of the AIDC sensor 203 into those in the above-mentioned initial state.

(a) Structure of digital full color copying machine

FIG. 1 is a longitudinal cross sectional view of the whole structure of the digital full color copying machine according to the present preferred embodiment of the present invention.

Referring to FIG. 1, the digital full color copying machine of the present preferred embodiment is mainly divided into two parts of an image reader part 1 for reading an image of an original (referred to as an original image hereinafter) and converting image signals of the read original image into image data for representing image densities of images of four colors of yellow (Y), magenta (M), cyan (C) and black (K), and a printer part 2 for printing the read original image on a sheet of copying paper based on the converted image data.

As shown in FIG. 1, a scanner 10 comprises an exposure lamp 12 for illuminating an original, a rod lens array 13 for condensing a reflected light from the original, and a contact type CCD color image sensor 14 for converting the original image of the condensed light into electric image signals. When the original is to be read, the scanner 10 is driven by a motor 11 so as to be moved in a subscan direction indicated by an arrow A1, thereby scanning the original placed on an original glass table 15. The original image on the original surface illuminated by the exposure lamp 12 is photoelectrically converted into image density signals by the image sensor 14. The image density signals for respectively representing the image densities of three colors of red (R), green (G) and blue (B) are converted into (8×4) bit gradation data of four colors of yellow Y, magenta M, cyan C and black K. Thereafter, a print head controller 202 performs a $\gamma$ correction process and a dither process corresponding to gradation characteristics of the photoconductive drum 41 for the inputted gradation data, and then, a print head part 31 performs a digital to analogue conversion process (referred to as a D/A conversion process hereinafter) for image data for which the $\gamma$ correction process and the dither process have been performed so as to generate an analogue laser diode driving signal. Thereafter, a laser diode 221 shown in FIGS. 2*b* and 3 is driven by the laser diode driving signal outputted from the print head part 31.

A beam of laser light emitted from the laser diode 221 in accordance with the gradation data is projected through a reflection mirror 37 onto the photoconductive drum 41 which is rotated in a direction as indicated by an arrow A2, thereby exposing the surfaces of the photoconductive drum 41 to the laser light. Then, the original image is formed on a photoconductor of the photoconductive drum 41. The photoconductive drum 41 is illuminated by an eraser lamp 42 prior to the exposure of the laser light every one copying operation, and then, is electrically charged uniformly by the corona charger 43. Therefore, when the photoconductive drum 41 in the uniformly charged state is exposed to a beam of laser light, an electrostatic latent image is formed on the photoconductive drum 41. Thereafter, either one of the developing devices 45*a* to 45*d* which respectively include yellow, magenta, cyan and black toners is selected, and the selected one thereof develops the electrostatic latent image formed on the photoconductive drum 41 with toner so as to form a toner image. The toner image after completion of the development process is transferred by a transfer charger 46 onto a sheet of copying paper which is fed from a paper cassette 50, and then is wound around a transfer drum 51. On the other hand, the light amount of the reflected light from the developed toner image is optically detected by the AIDC sensor 203 provided at a position closer to the side of the developing device 45*d* than a transfer position at which the photoconductive drum 41 is in contact with the transfer drum 51.

The above-mentioned printing process is repeated for every color of yellow, magenta, cyan and black. At that time, the scanner 10 repeatedly scans in synchronization with the rotation of the photoconductive drum 41 and the transfer drum 51. Then, the copying paper is separated from the transfer drum 51 by a separating nail 47, the toner image formed on the copying paper is fixed by a fixing device 48, and then, the copying paper is discharged onto a discharge tray 49. It is to be noted that the copying paper is supplied from the paper cassette 50, an end of which is chucked by a chucking mechanism 52 provided on the transfer drum 51 so as to prevent any positional displacement of the copying paper upon the transfer.

Figure 2A:
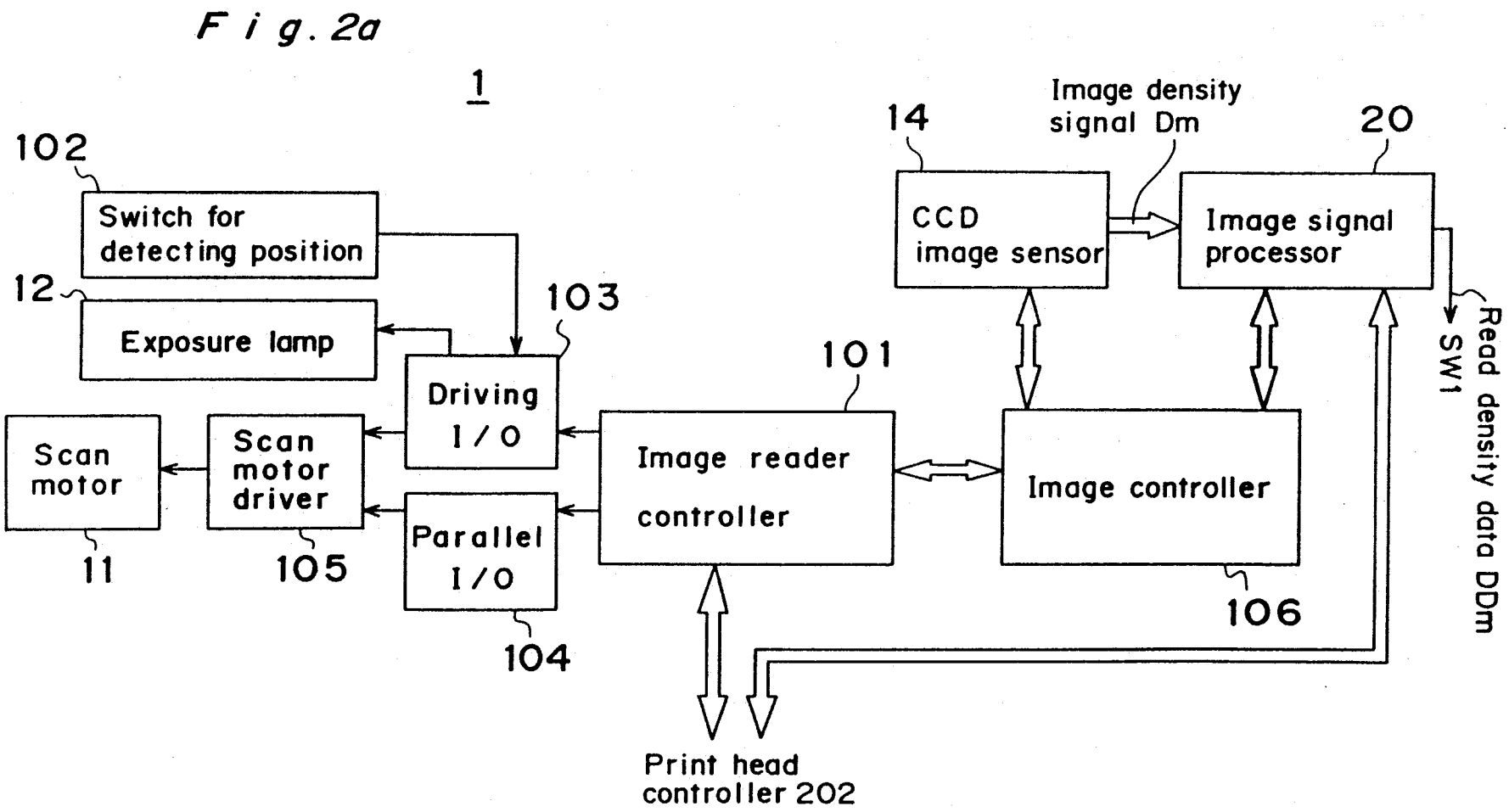
FIGS. 2*a*, 2*b* and 2*c* are block diagrams of the digital full color copying machine shown in FIG. 1.
Figure 2B:
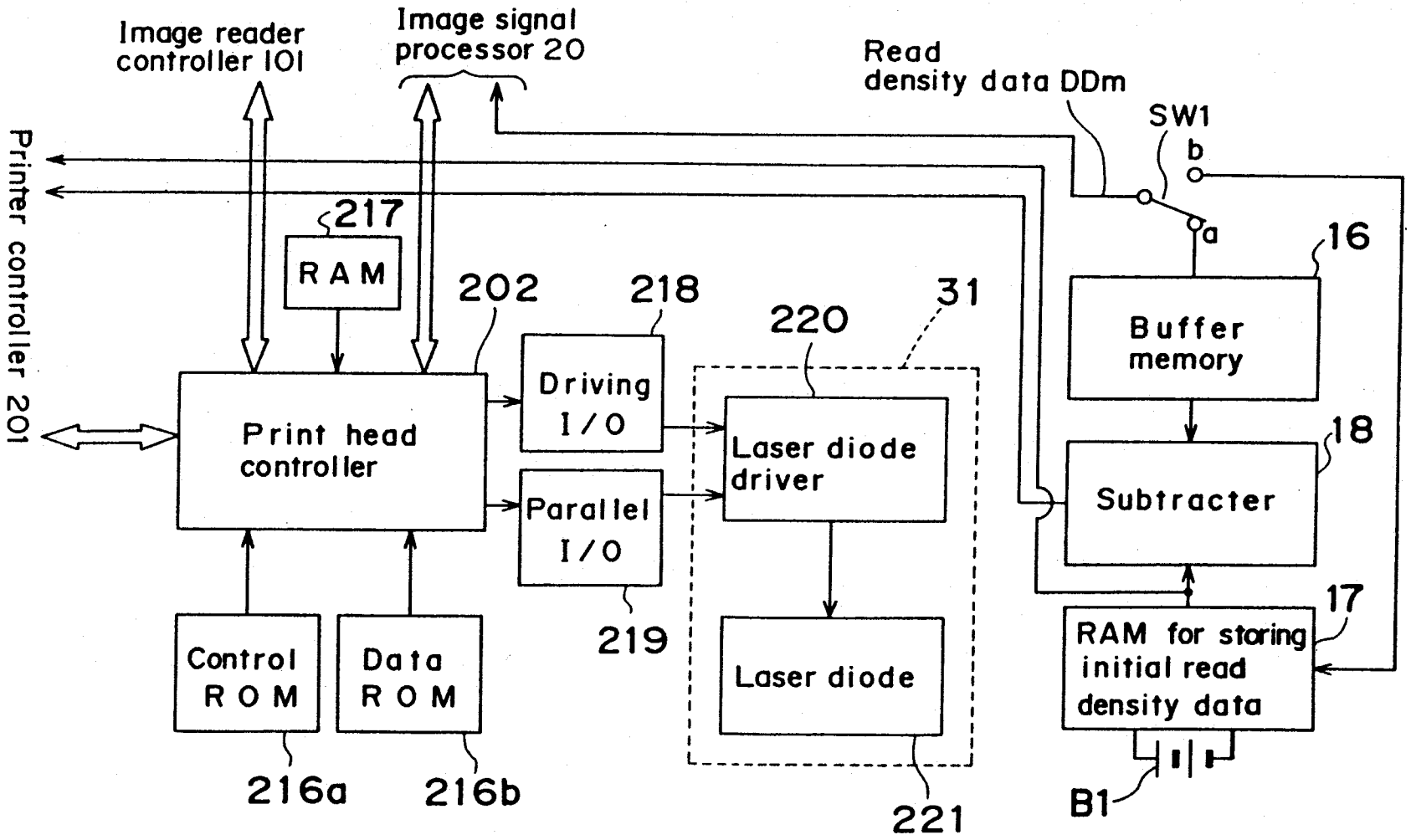
Figure 2C:
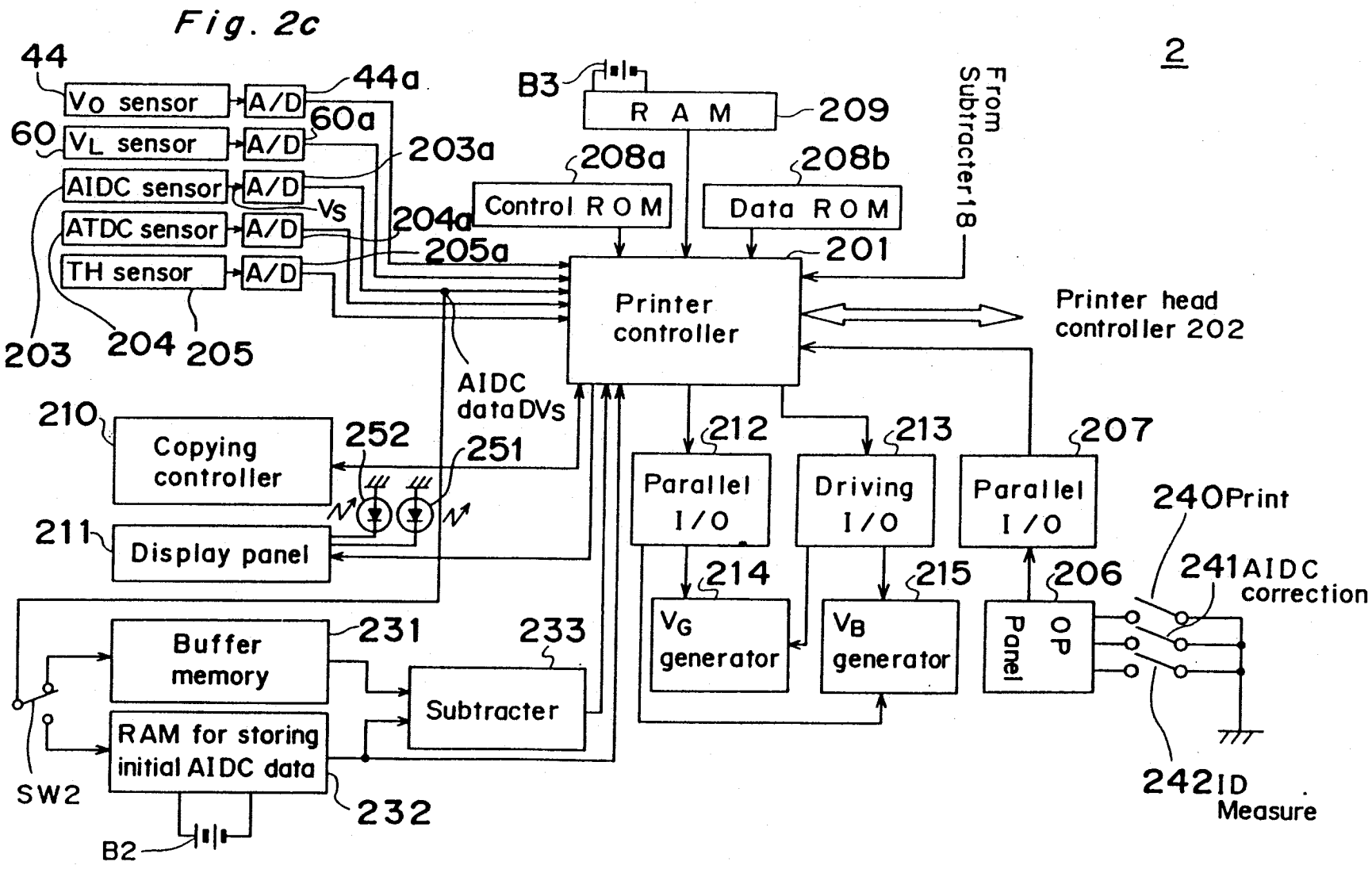
Figure 3:
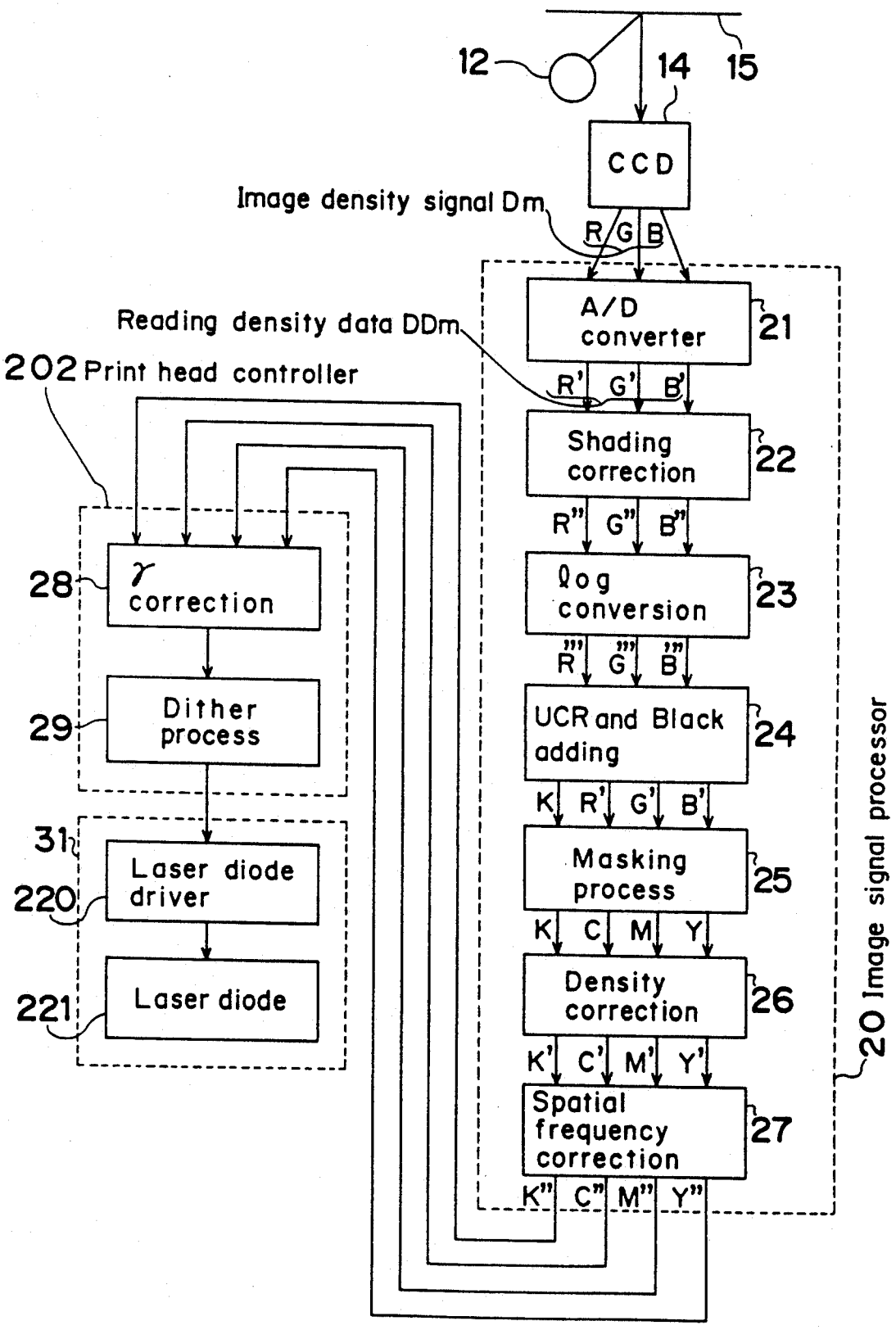
FIG. 3 is a block diagram of an image signal processing part, a print head controller and a print head part of the digital full color copying machine shown in FIGS. 1 and 2*a* to 2*c;*
Figure 4:
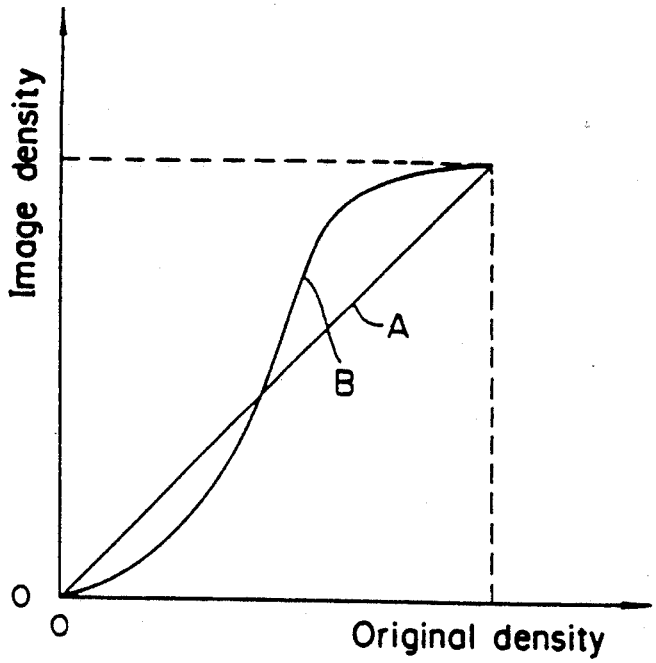
Fig. 4 PRIOR ART
FIG. 4 is a graph of an example of a $\gamma$ characteristic.

FIGS. 2*a* to 2*c* are block diagrams of the whole of the digital full color copying machine of the present preferred embodiment.

Referring to FIG. 2*a*, an image reader controller 101 for controlling the operation of the image reader part 1 controls the exposure lamp 12 through a driving input and output interface circuit (referred to as a driving I/O hereinafter) 103 on the basis of a position signal from a position detecting switch 102 for showing a position of the original placed on the original glass table 15. Further, the image reader controller 101 controls a scan motor driver 105 through the driving I/O 103 and a parallel input and output interface circuit (referred to as a parallel I/O hereinafter) 104. The scan motor 11 is driven by the scan motor driver 105.

On the other hand, the image reader controller 101 is electrically connected to an image controller 106 through a bus. The image controller 106 is electrically connected to the CCD color image sensor 14 and an image signal processing part 20 through respective buses. An image density signal Dm outputted from the CCD image sensor 14 is inputted to the image signal processing part 20, and then, is processed by the image signal processing part 20 which will be depicted more in detail later.

Referring to FIGS. 2*b* and 2*c*, the printer part 2 comprises a printer controller 201 for controlling the copying process, and the print head controller 202 for controlling the print head part 31.

To the printer controller 201, there are inputted analogue electric signals outputted from a Vo sensor 44 for detecting the surface electric potential Vo prior to the exposure of the photoconductive drum 41, a $V_L$ sensor 60 for detecting the surface electric potential $V_L$ immediately after the exposure of the photoconductive drum 41, the AIDC sensor 203 for detecting the light amount of the reflected light from the toner image adhering onto the surface of the photoconductive drum 41, an ATDC sensor 204 for detecting toner densities of toners provided within the developing devices 45*a* to 45*d*, and a temperature and humidity sensor (referred to as a TH sensor in the drawings) 205 through respective analogue to digital converters (referred to as A/D converters hereinafter) 44*a*, 60*a*, 203*a*, 204*a* and 205*a*.

It is to be noted that the analogue output voltage Vs outputted from the AIDC sensor 203 is converted into digital output voltage data DVs (referred to as an AIDC data) by the A/D converter 203*a*. The AIDC data DVs are inputted to not only the printer controller 201 but also a common terminal of a switch SW2 which is controlled to be switched over by the printer controller 201. A terminal a of the switch SW2 is electrically connected to a buffer memory 231 for temporarily storing the output voltage data DVs, while a terminal b of the switch SW2 is electrically connected to a RAM 232 for storing the AIDC data Dvs of the AIDC sensor 203 detected in the above-mentioned initial state of the digital full color copying machine immediately before shipping it (referred to as initial AIDC data). The initial AIDC data stored in the RAM 232 are always retained by a backup battery B2 even when the digital full color copying machine is turned off. Both of the AIDC data read out from the buffer memory 231 and the initial AIDC data read out from the RAM 232 are inputted to a subtracter 233, which calculates a difference of these data. Thereafter, data of the calculated difference are outputted to the printer controller 201. Moreover, the initial AIDC data read out from the RAM 232 are directly inputted to the printer controller 201.

An operation panel 206 comprises plural switches, namely, a print switch 240 for starting the copying operation, the AIDC correction switch 241 to be used when the AIDC correction process is carried out which will be described in detail later, and an ID measuring switch 242 (referred to as an ID-MPSW in the drawings) to be used in an ID measurement process which will be described in detail later. Information data outputted from the respective switches 240 to 242 of the operation panel 206 are inputted to the printer controller 201 through a parallel I/O 207.

The printer controller 201 is electrically connected further to a control ROM 208*a* for storing a control program, a data ROM 208*b* for storing various kinds of data, and a RAM 209 for being used as a working area of the printer controller 201 and for storing various kinds of data such as $V_G$ and $V_B$ tables which are used for the copying process and the image density control process executed in the present preferred embodiment. The data stored in the RAM 209 are always retained by a backup battery B3 even through the digital full color copying machine is turned off. The $V_G$ and $V_B$ table as mentioned above is a table for showing a relationship among the output voltage Vs of the AIDC sensor 203, the grid voltage $V_G$ and the developing bias voltage $V_B$. Table 1 shows a $V_G$ and $V_B$ table in the above-mentioned initial state immediately before shipping the digital full color copying machine from the factory for manufacturing it.

Moreover, referring to FIG. 2*b*, read density data DDm obtained by analogue to digital converting the analogue image density signal Dm are inputted from the A/D converter 21 provided in the image signal processing part 20 of the image reader part 1 to a common terminal of a switch SW1 which is controlled by the printer controller 201. A terminal a of the switch SW1 is electrically connected to a buffer memory 16 for temporarily storing the density data DDm, while a terminal b thereof is electrically connected to the RAM 17 for storing the read density data DDm (referred to as initial read density data hereinafter) obtained by analogue to digital converting the image density signal Dm which is outputted from the CCD image sensor 14 when a sample sheet is used immediately before the copying machine is shipped out from the factory. The initial read density data stored in the RAM 17 is always retained by a backup battery B1 even if the digital full color copying machine is turned off. After both of the read density data read out from the buffer memory 16 and the initial read density data read out from the RAM 17 are inputted to a subtracter 18, a difference of these data is calculated by the subtracter 18, and then, data of the calculated difference are outputted to the printer controller 201. The data read out from the RAM 17 are also inputted directly to the printer controller 201.

Referring to FIG. 2*c*, the printer controller 201 performs an copying operation by controlling the copying controller 210 and the print head controller 202 according to the control program stored in the control ROM 208*a* based on various kinds of data outputted from the sensors 44, 60 and 203 to 205, the operation panel 206, the data ROM 208*b*, the ROM 209, the subtracters 18 and 233 and the RAM 232 for storing the initial AIDC data and the RAM 17 for storing the initial read density data. Upon the copying operation, the printer controller 201 outputs information data required for the copying operation to a display panel 211 so as to display them on the display panel 211. It is to be noted that the display panel 211 comprises a warning light emitting diode (referred to as a warning LED hereinafter) 251 used in a first warning process shown in FIGS. 22*a* to 22*d*, and a warning LED 252 used in a second warning process shown in FIG. 23.

Figure 5:
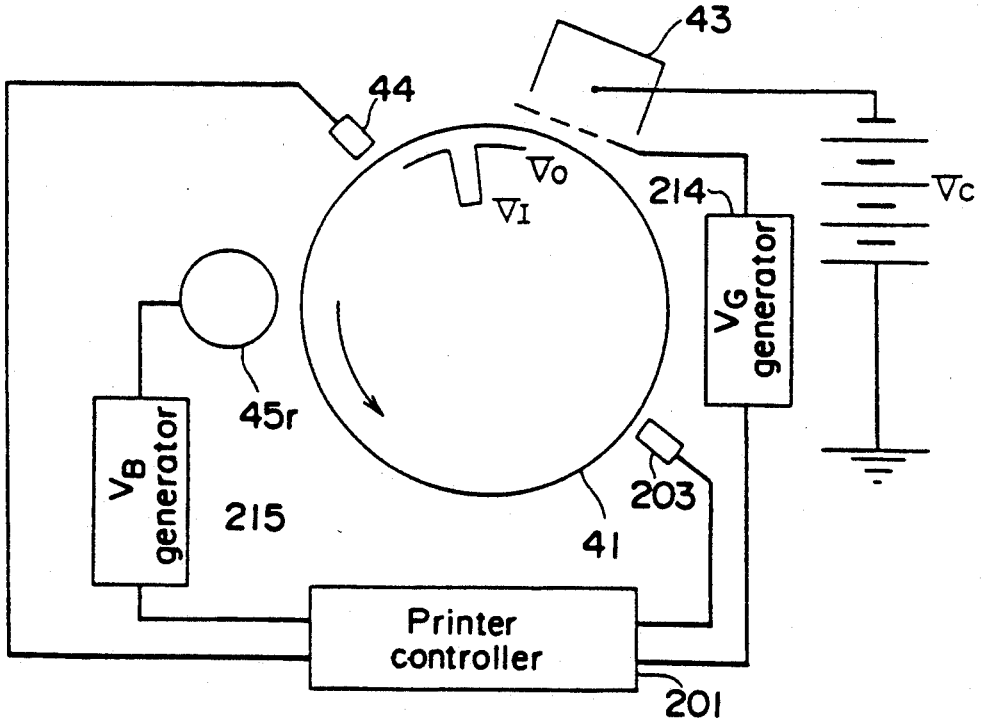
Fig. 5 PRIOR ART
FIG. 5 is a block diagram of respective units provided around a photoconductive drum of the digital full color copying machine shown in FIGS. 1 and 2*a* to 2*c;*

Further, as will be discussed in detail later, the printer controller 201 carries out the automatic image density control process, and then, controls a high voltage $V_G$ generator 214 for generating the grid voltage $V_G$ of the corona charger 43 and a high voltage $V_B$ generator 215 for generating the developing bias voltage $V_B$ of the developing roller 45*r* of the developing devices 45*a* to 45*d* shown in FIG. 5 through a parallel I/O 212 and a driving I/O 213. During the image density control process, the printer controller 201 transmits data of set values of not only the grid voltage $V_G$ corresponding to the surface electric potential Vo of the photoconductive drum 41 but also the developing bias voltage $V_B$ to the print head controller 202.

Referring to FIG. 2*b*, the print head controller 202 is electrically connected with a control ROM 216*a* for storing a control program, a data ROM 216*b* for storing various kinds of data, and a RAM 217 for being used as a working area of the print head controller 202 and for storing various kinds of data used for the $\gamma$ correction process and the dither process as described later. The print head controller 202 is electrically connected to the printer controller 201 through a bus, and is also electrically connected to the image reader controller 101 and the image signal processing part 106 through respective image data buses. The print head controller 202 operates according to the control program stored in the control ROM 216*a*, and also performs the $\gamma$ correction process for respective image data of four colors Y, M, C and K which are received from the image signal processing part 20 of the image reader part 1 through the image data bus with referring to the $\gamma$ correction table stored in the data ROM 216*b* Moreover, if the multi-value dither matrix method is used for presenting the gradation, the print head controller 202 generates the print driving signal to the laser diode driver 220 of the print head part 31 through the driving I/O 218 and the parallel I/O 219. Emission of a beam of laser light from the laser diode 221 is controlled by the laser diode driver 220 based on the print driving signal.

According to the present preferred embodiment, two methods can be used to express the gradation, that is, there can be used not only a multi-value laser exposure method such as the pulse width modulation method, the intensity modulation method or the like, but also a multi-value dither method which is a combination of the dither method and the pulse width modulation method or the intensity modulation method. Either one of the above two methods is selected by the operator using a gradation expression selection switch (not shown) which is provided the operation panel 206.

Further, in the present preferred embodiment, in the case where there is used the multi-value laser exposure method according to the intensity modulation method or the pulse width modulation method, the print head controller 202 selects either one of plural $\gamma$ correction tables stored in the data ROM 216*b* on the basis of the set value data of the grid voltage $V_G$ and the developing bias voltage $V_B$ which are received from the printer controller 201. On the other hand, in the case where there is used the multi-value dither method, the print head controller 202 selects either one of plural dithers and performs the dither process using the selected dither.

(b) Processing of Image signal

FIG. 3 is a block diagram showing a processing flow of the image signals which are transmitted from the CCD image sensor 14 through the image signal processing part 20 and the print head controller 202 to the print head 31. Referring now to FIG. 3, there will be described below processing of the image signal, that is, how to process the image density signal Dm outputted from the CCD color image sensor 14, thereby generating the print driving signal for driving the laser diode 221.

In the image signal processing part 20, the image density signals Dm of signals R, G and B photoelectrically converted by the CCD color image sensor 14 are inputted to the A/D converter 21, and then, are converted into (8×3) bit digital read density data DDm of respective colors R, G and B composed of image data R', G' and B'. Thereafter, the read density data DDm of respective colors are inputted to a shading correction circuit 22 for performing a predetermined shading correction. Since the image data R", G" and B" after completion of the shading correction are data of reflected light amounts obtained by reading images of the reflected lights from the original using the CCD image sensor 14, a logarithmic conversion circuit 23 carries out a logarithmic conversion process for the inputted image data, thereby converting them into image data for indicating the actual density of the original image. Thereafter, an under color removal and black adding circuit 24 performs an under color removal process and a black adding process for the inputted image data, thereby removing unnecessary black components from the inputted image data and also generating black image data K based on the inputted image data of three colors R, G and B. Thereafter, a masking circuit 25 performs a masking process for the image data of three colors R, G and B inputted from the under color removal and black adding circuit 24, thereby converting them into image data of three colors yellow Y, magenta M and cyan C. Then, a density correction circuit 26 performs a density correction process for multiplying the image data of three colors Y, M and C converted by the masking circuit 25 by predetermined coefficients. Thereafter, a spatial frequency correction circuit 27 performs a predetermined spatial frequency correction process known to those skilled in the art for respective image data after completion of the density correction process, and outputs respective image data of four colors yellow Y, magenta M, cyan C and black K after completion thereof to a $\gamma$ correction circuit 28 of the print head controller 202.

The $\gamma$ correction circuit 28 performs a $\gamma$ correction process for the respective image data of four colors Y, M, C and K outputted from the spatial frequency correction circuit 27 using the $\gamma$ correction table provided in the data ROM 216*b*. Thereafter, if the multi-value dither method is used to express the gradation, a dither circuit 29 performs a dither process for the inputted image data based on the dither threshold table stored in the data ROM 216*b*, and then, outputs a print driving signal after completion of the dither process to the laser diode driver 220 of the print head part 31. In the data ROM 206*b* connected to the print head controller 202, there are stored plural $\gamma$ correction tables used in the above-mentioned $\gamma$ correction process and plural dither threshold tables used in the dither process. Thereafter, there are selected either one of these $\gamma$ correction tables and either one of the dither threshold tables on the basis of the set value data of the grid voltage $V_G$ and the developing bias voltage $V_B$ which are received from the printer controller 201, and then, the above-mentioned $\gamma$ correction and the above-mentioned dither process are performed using the selected tables.

(c) Image density control process

In the present preferred embodiment, there is performed the above-mentioned $\gamma$ correction process, however, as one of phenomena due to another cause for influencing the image density, there is such a phenomenon that an adhering amount of toner onto the photoconductive drum 41 changes upon the developing process using the toner when characteristics of the photoconductor and the toner changes due to change in external circumstances such as the temperature, the humidity, etc. Generally speaking, the following is known to those skilled in the art in this case. Namely, the adhering amount of toner increases under circumstances of a high temperature and a high humidity so that the original image having a higher image density is reproduced with a $\gamma$ characteristic having a relatively large gradient in a relatively high original density. On the other hand, the adhering amount of toner decreases under circumstances of a low temperature and a low humidity so that the original image having a lower image density is reproduced with a $\gamma$ characteristic having a relatively small gradient in relatively low and middle original densities.

Thus, there is such a problem that the reproduced image density changes due to change in the circumstances. In order to solve the above-mentioned problem so as to obtain a stable proper image density, the following image density control process is performed in the present preferred embodiment.

In the digital full color copying machine of the present preferred embodiment, the toner densities of the respective color developers provided in the developing devices 45*a* to 45*d* are detected by the ATDC sensor 204 shown in FIG. 2*c*, and then, the toner densities of the respective developers are controlled so as to be constant by a conventional automatic toner density control process (referred to as an ATDC process hereinafter) known to those skilled in the art, based on the detected toner densities of the respective developers. Further, after the light amounts of the reflected lights from four color toner images C, M, Y and K of the reference test pattern formed on the photoconductive drum 41 are measured by the AIDC sensor 203, the grid voltage $V_G$ and the developing bias voltage $V_B$ of the corona charger 43 are changed based on the measured light amounts so as to making the image density upon performing the copying operation in the digital full color copying machine constant, in spite of change in the circumstances.

The relationship among the output voltage Vs of the AIDC sensor 203, the grid voltage $V_G$ and the developing bias voltage $V_B$ is stored as the $V_G$ and $V_B$ table in the RAM 209 for respective four colors cyan C, magenta M, yellow Y and black K. The $V_G$ and $V_B$ table in the initial state is shown in Table 1. As is apparent from Table 1, set values of the combinations of the grid voltage $V_G$ and the developing bias voltage $V_B$ corresponding to respective ones of the output voltage Vs of the AIDC sensor 203 are previously prepared as plural tables. The $V_G$ and $V_B$ tables are stored in the RAM 209 every color of four colors cyan C, magenta M, yellow $\gamma$ and black K.

The image density control process to be performed in the digital full color copying machine of the present preferred embodiment will be described below in detail.

Figure 6:
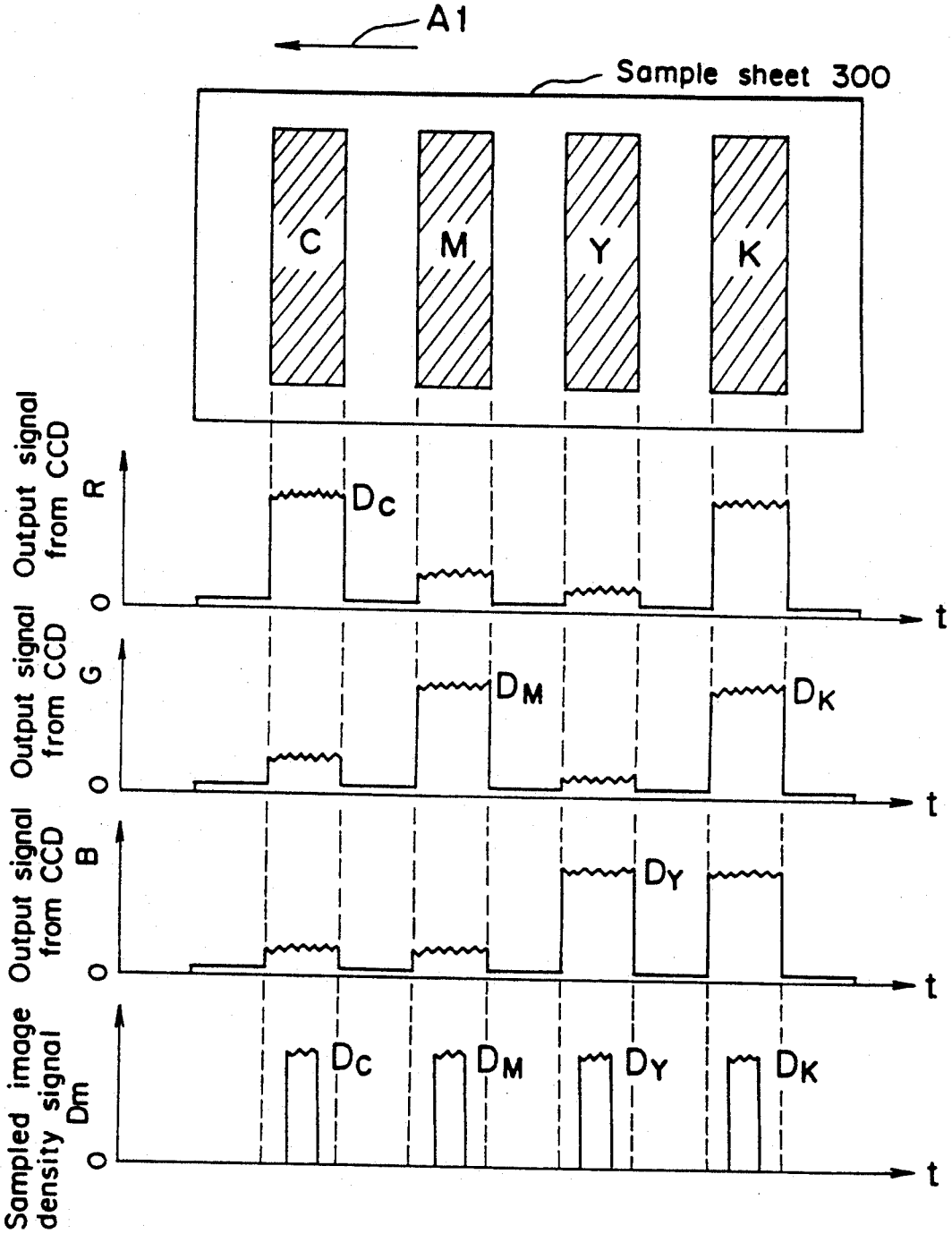
FIG. 6 is a plane view of a sample sheet used in the digital full color copying machine of FIGS. 1 and 2*a* to 2*c*, and a timing chart of output signals of a CCD image sensor when the CCD image sensor reads the sample sheet.

(1) As shown in FIG. 6, in the initial state of the digital full color copying machine immediately before shipping out it from the factory, while there is printed the sample sheet 300 having reference test pattern images of four colors C, M, Y and K formed thereon, the image densities of the toner images of four colors formed on the photoconductive drum 41 are measured by the AIDC sensor 203. The AIDC data Dvs corresponding to the measured image densities are stored as the initial AIDC data in the RAM 232, while the printed sample sheet 300 are read by the CCD image sensor 14 and then the read density data DDm of the reference test pattern images of four colors included in the sample sheet 300 are stored as the initial read density data in the RAM 17. Thereafter, images of the sample sheet 300 is read and the reference test pattern toner images of four colors corresponding to the read images are formed on the photoconductive drum 41, and then, light amounts of reflected lights from the respective toner images are measured by the AIDC sensor 203. The measured AIDC data DVs are stored as the initial AIDC data in the RAM 232.

Figure 7:
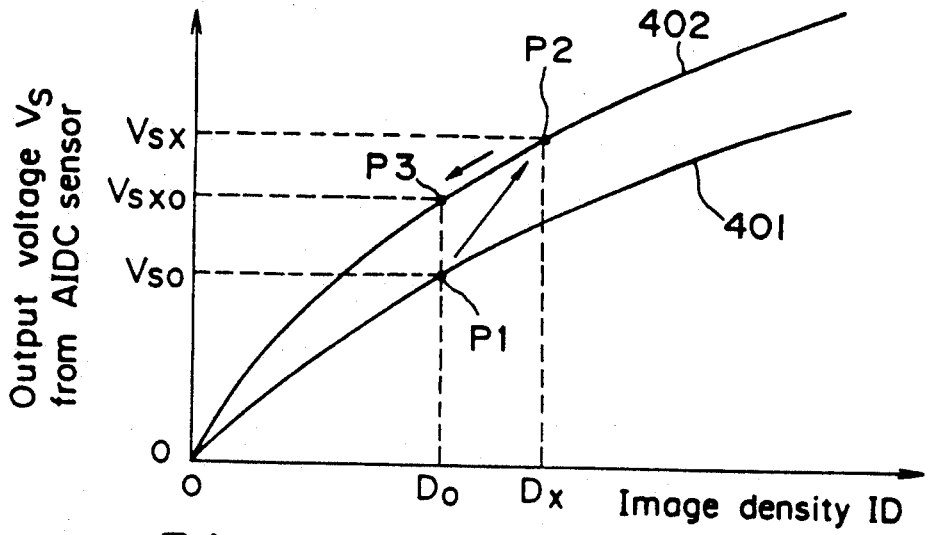
FIG. 7 is a graph of a relationship between an image density and an output voltage of an AIDC sensor showing an image density control process performed in the digital full color copying machine shown in FIGS. 1 and 2*a* to 2*c;*

(2) A characteristic curve 401 of FIG. 7 shows a relationship between the image density of each color and the output voltage Vs of the AIDC sensor 203 in the initial state. As shown in FIG. 7, as the image density becomes larger, the output voltage Vs is larger.

It is assumed that a characteristic point of the output voltage Vs of the AIDC sensor 203 on the characteristic curve 401 is P1 and the corresponding output voltage Vs is Vso, when an image density of a color measured with use of the sample sheet 300 is Do in the initial state. Thereafter, when the original density and the image density are respectively shifted from those in the initial state due to deterioration of the développers, change in the sensitivity of the photoconductive drum 41, or change in the circumstances (referred to as a time of characteristic changed hereinafter), it is assumed that the above-mentioned characteristic curve 401 changes to a characteristic curve 402 as shown in FIG. 7. At that time, when the AIDC measuring process is performed using the sample sheet 300, it is assumed that an image density of a color becomes Dx, a characteristic point of the output voltage Vs of the AIDC sensor 203 is P2 at that time, and the output voltage Vs becomes Vsx.

At the time of characteristic changed, the image density in the copying process should be the image density Do of the initial state, and therefore, the characteristic point at that time should be positioned at P3 in the output voltage Vs of the AIDC sensor 203 to the image density characteristic shown in FIG. 7. In other words, it is necessary to shift the characteristic point P2 to P3 on the characteristic curve 402. The output voltage Vs of the AIDC sensor 203 at the characteristic point P3 after shifting the characteristic point is expressed by the following approximate equation:

$$Vsxo \approx \frac{Do}{Dx} \cdot Vsx \tag{1}$$

In the present preferred embodiment, when an absolute value $|Dx-Do|$ of the shift amount of the image density is larger than a predetermined threshold value $\Delta D$, the calculation of the above equation (1) is performed for every color of four colors C, M, Y and K. Approximation calculations for each color corresponding to the above equation (1) are expressed as follows:

$$Vsxco \approx \frac{Dco}{Dcx} \cdot Vscx \tag{2a}$$

$$Vsxmo \approx \frac{Dmo}{Dmx} \cdot Vsmx \tag{2b}$$

$$Vsxyo \approx \frac{Dyo}{Dyx} \cdot Vsyx \tag{2c}$$

$$Vsxko \approx \frac{Dko}{Dkx} \cdot Vskx \tag{2d}$$

(3) Subsequently, on the basis of the output voltage Vs of the AIDC sensor 203 at the characteristic point P3 after shifting the characteristic point, set values of the grid voltage $V_G$ and the developing bias voltage $V_B$ corresponding to the output voltage Vs in the $V_G$ and $V_B$ table for each color are respectively shifted from those the initial state shown in Table 1 to those shown in Table 2. This process is referred to as an AIDC correction process hereinafter. Thereafter, upon starting a normal copying process, a suitable $\gamma$ correction table is selected from plural tables based on the above corrected $V_G$ and $V_B$ table. Accordingly, it always becomes possible to reproduce an original image having a constant gradation reproducibility for the original.

(4) In the present preferred embodiment, when the developing devices 45a to 45d are exchanged with new ones after performing the AIDC correction process, there is performed an initialization process of the $V_G$ and $V_B$ table. More specifically, the set values of the grid voltage $V_G$ and the developing bias voltage $V_B$ corresponding to the output voltage Vs in the $V_G$ and $V_B$ table for each color are respectively shifted to the set values in the initial state shown in Table 1 based on the output voltage Vs of the AIDC sensor 203 at the shifted characteristic point P3 calculated in the AIDC correction process.

(d) Controlling flow of printer controller

Figure 10A:
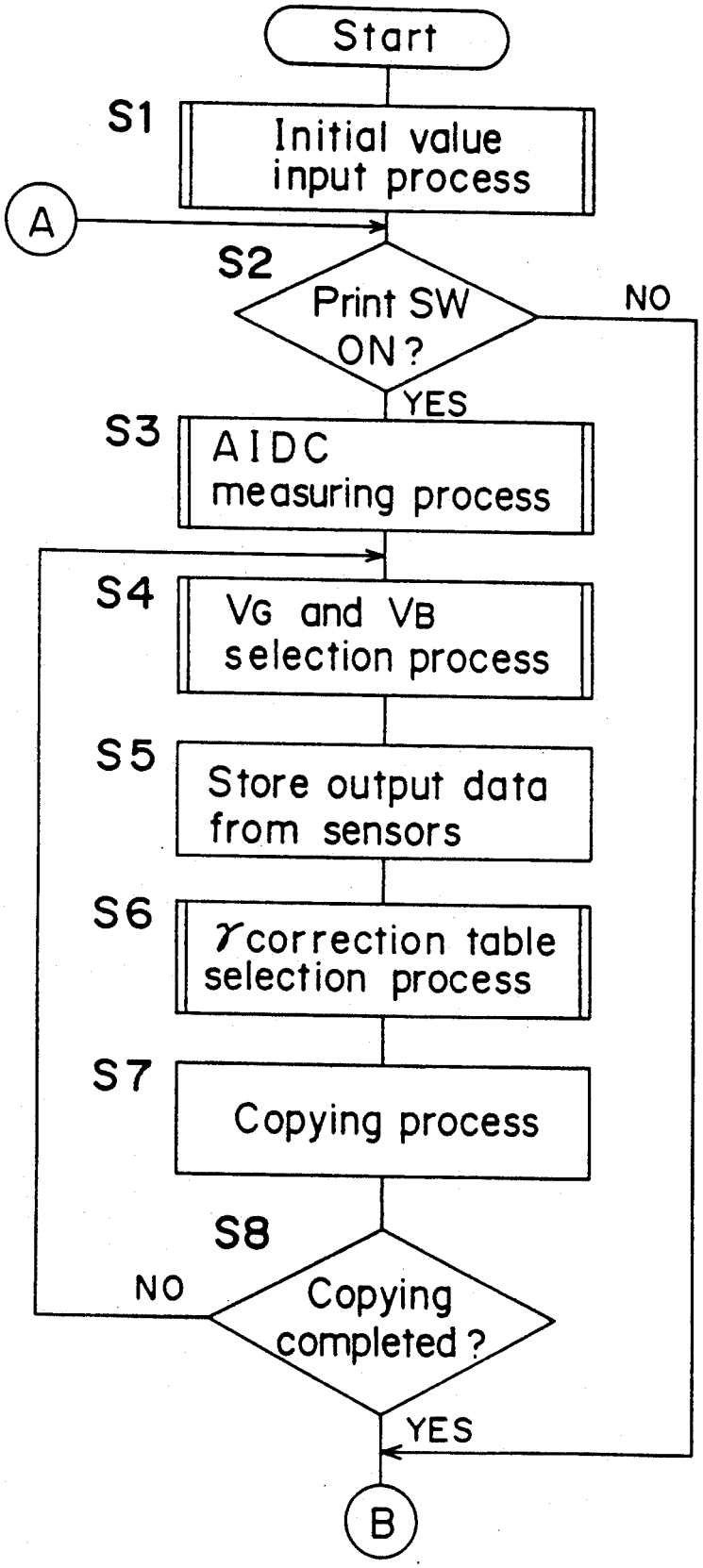
FIGS. 10*a*, and 10*b* are flow charts of a main routine executed by the printer controller of the digital full color copying machine shown in FIGS. 2*a* to 2*c*.
Figure 10B:
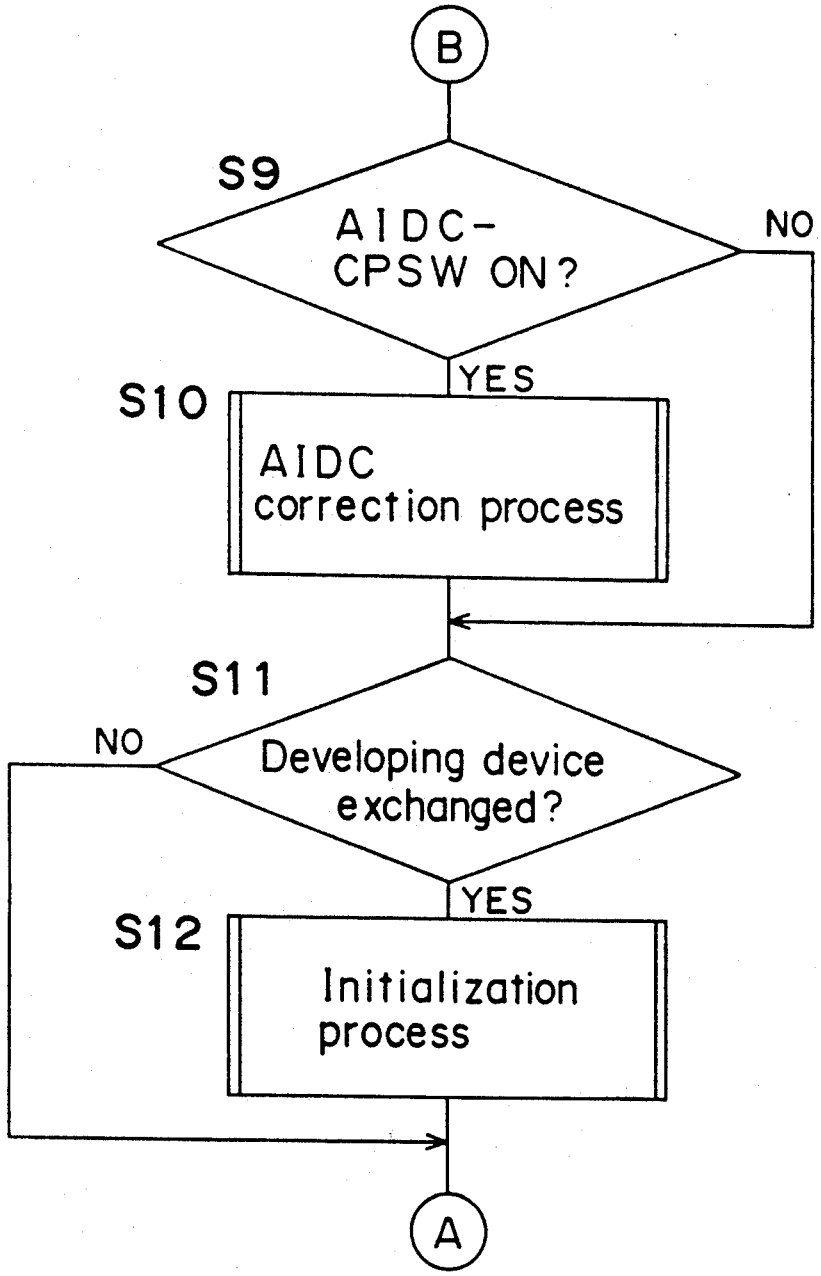

FIGS. 10a and 10b are flow charts of a main routine executed by the printer controller 201 of the digital full color copying machine of the present preferred embodiment.

In step 1 of the main routine shown in FIG. 10a, when the ID measuring switch 242 is turned on, an initial value input process is started, and then, there are stored not only the initial AIDC data in the initial state immediately before shipping the copying machine but also the initial read density data. Processes of steps S2 to S8 are started when the print switch 240 is turned on so as to perform a normal copying operation. The image density control process of the present preferred embodiment is carried out in steps S9 and S10 shown in FIG. 10b by turning on the AIDC correction switch 241. The $V_G$ and $V_B$ table is initialized in an initialization process of steps S11 and S12 when the developing devices 45a to 45d are exchanged wit new ones.

Referring to FIGS. 10a, in the main routine of the print controller 201, after the initial values are inputted in step S1, it is checked in step S2 whether or not the print switch 240 is turned on. When the print switch 240 is turned on (YES in step S2), the program flow moves to step S3. On the other hand, if the print switch 240 is not turned on (NO in step S2), the program flow moves to step S9 of FIG. 10a.

After performing the AIDC measuring process in step S3 wherein the output voltage Vs of the AIDC sensor 203 is detected in order to measure the light amounts of the reflected lights from the toner images formed on the photoconductive drum 41, there is performed the $V_G$ and $V_B$ selection process for selecting the grid voltage $V_G$ and the developing bias voltage $V_B$ using the $V_G$ and $V_B$ table presently stored in the RAM 209 based on the measured output voltage Vs in step S4. Thereafter, data detected by various sensors 44, 66 and 203 to 205 are stored in the RAM 209 in step S5, and then, a suitable $\gamma$ correction table is selected in step S6 from the plural $\gamma$ correction tables on the basis of the grid voltage $V_G$ and the developing bias voltage $V_B$ selected in the $V_G$ and $V_B$ selection process. Furthermore, after there is performed the copying process for copying an original placed on the original glass table 15 in step S7, the program flow goes to step S8.

It is checked in step S8 whether or not the copying process is completed. If the copying process is completed (YES in step S8), the program flow advances to step S9 of FIG. 10b. If the copying process is not completed (NO in step S8), the program flow returns to step S4.

In step S9, it is detected whether or not the AIDC correction switch 241 is turned on. When the AIDC correction switch 241 is turned on (YES in step S9), the AIDC correction process is carried out in step S10, and then, the program flow proceeds to step S11. On the other hand, when the AIDC correction switch 241 is not turned on (NO in step S9), the program flow moves to step S11.

In step S11, it is detected whether or not the developing devices 45*a* to 45*d* are exchanged with new ones. When the developing devices 45*a* to 45*d* are exchanged with new ones (YES in step S11), the above-mentioned initialization process is performed in step S12, and then, the program flow returns to step S2. On the other hand, if the developing devices 45*a* to 45*d* are not exchanged with new ones (NO in step S11), the program flow returns to step S2.

Figure 11:
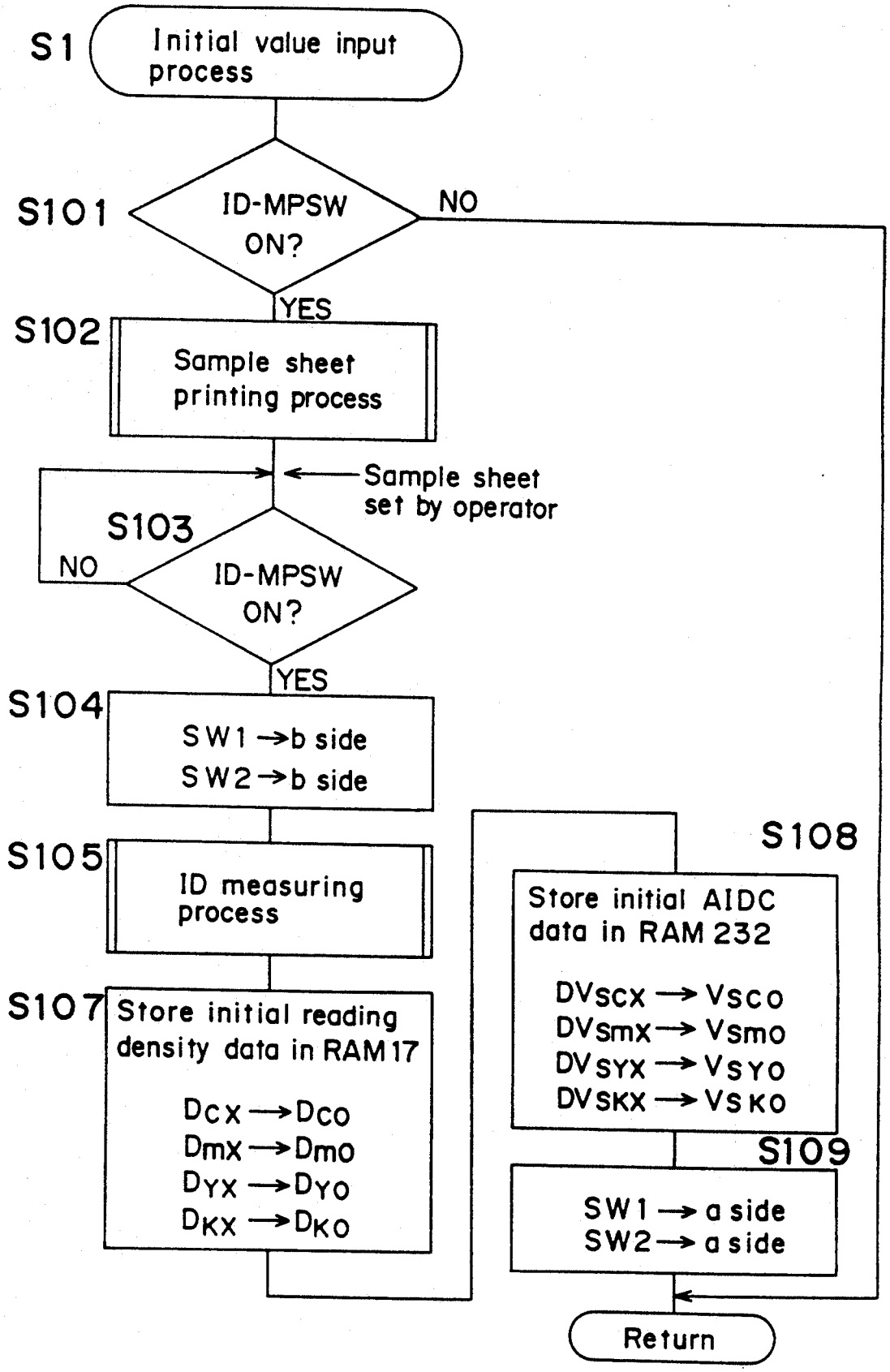
FIG. 11 is a flow chart of an initial value input process of a subroutine shown in FIG. 10*a;*

FIG. 11 is a flow chart of the initial value input process of the subroutine (step S1) shown in FIG. 10*a*.

Referring to FIG. 11, it is checked first in step S101 whether or not the ID measuring switch 242 is turned on. If the ID measuring switch 242 is turned on (YES in step S101), the program flow proceeds to step S102. In step S102, after printing the sample sheet 300 on which the reference test pattern images of four colors C, M, Y and K shown in FIG. 6 are formed, the program flow moves to step S103. On the other hand, if the ID measuring switch 242 is not turned on (NO in step S101), the program flow returns to the original main routine.

Prior to step S103, the operator places the printed sample sheet 300 onto the original glass table 15 and turns on the ID measuring switch 242 in order to perform processes from step S104 and afterwards.

It is judged in step S103 whether or not the ID measuring switch 242 is turned on. When the ID measuring switch 242 is not turned on (NO in step S103), the copying machine is kept waiting until the ID measuring switch 242 is turned on in step S103. On the other hand, the ID measuring switch 242 is turned on (YES in step S103), both the switches SW1 and SW2 are switched over to the terminal b in step S104. Thereafter, the program flow moves to step S105, and then, there is performed the ID measuring process for measuring the light amounts of the reflected lights from the images of four colors of the printed sample sheet 300.

Thereafter, in step S107, the read density data Dcx, Dmx, Dyx and Dkx of four colors C, M, Y and K which are measured in the preceding ID measuring process of step S105 are respectively stored as the initial read density data Dco, Dmo, Dyo and Dko in the RAM 17. Then, in step S108, the AIDC data DVscx, DVsmx, DVsyx and DVskx which are data of the output voltages Vs of the AIDC sensor 203 of four colors C, M, Y and K measured in the AIDC measuring process are respectively stored as the initial AIDC data Vsco, Vsmo, Vsyo and Vsko in the RAM 232. Finally, after the switches SW1 and SW2 are switched over to the terminal a in step S109, the program flow goes back to the original main routine.

Figure 12:
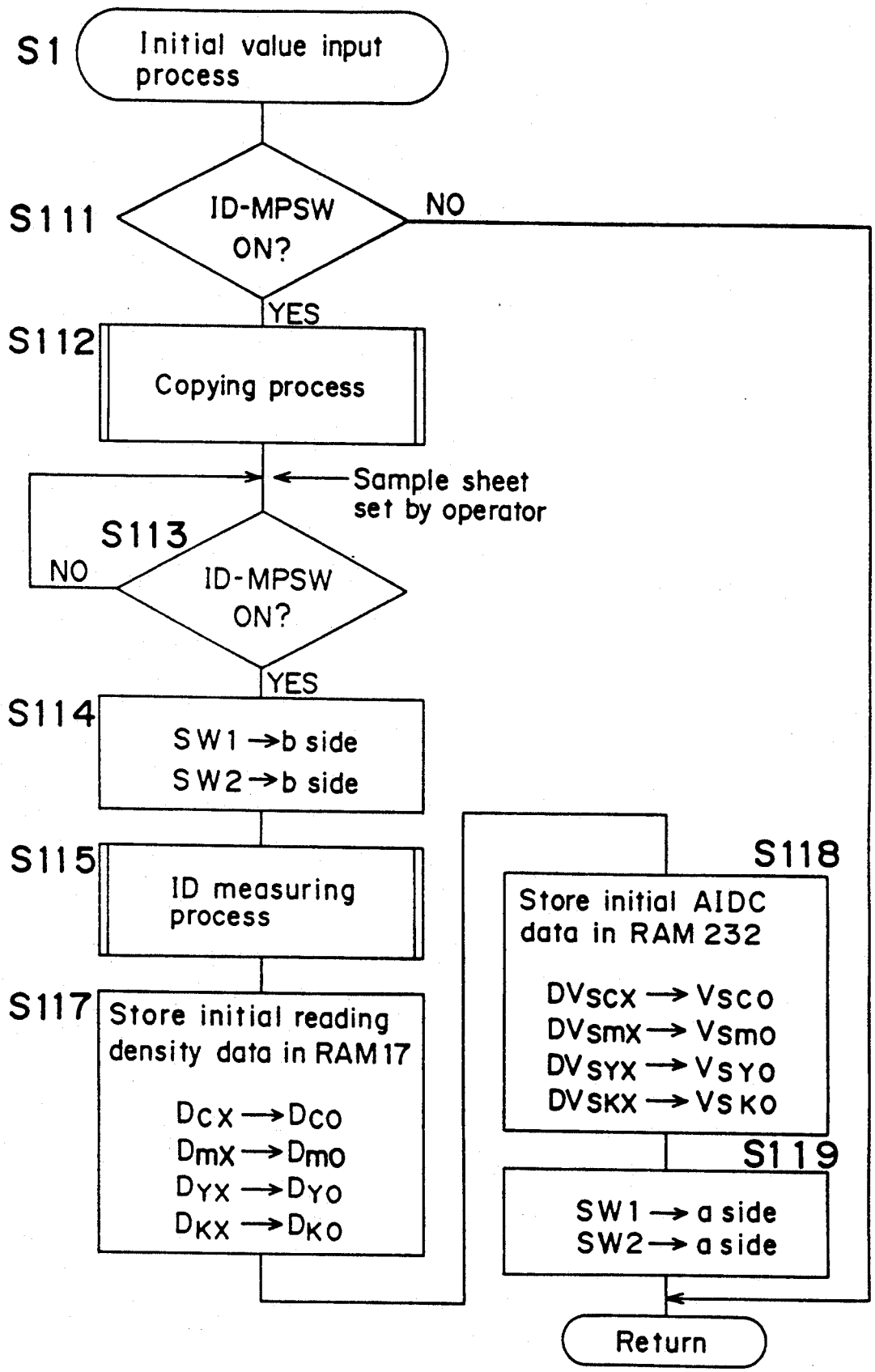
FIG. 12 is a flow chart of a modification of the initial value input process of the subroutine shown in FIG. 1.

FIG. 12 is a flow chart of a modification of the initial value input process of the subroutine (step S1) shown in FIG. 11. In the modified initial value input process, the copying process is performed for the already printed sample sheet 300, and then, processes are performed using the copy of the sample sheet 300 in manners similar to those of steps S105 to S108 shown in FIG. 11.

Referring to FIG. 12, it is checked in step S111 whether or not the ID measuring switch 242 is turned on. If the ID measuring switch 242 is turned on (YES in step S111), the program flow goes to step S112, and then, the copying process is performed for the already printed sample sheet 300, the program flow going to step S113. On the other hand, when the ID measuring switch 242 is not turned on (NO in step S111), the program flow returns to the main routine, directly.

Prior to step S113, the operator puts the copied sample sheet on the original glass table 15, and then, turns on the ID measuring switch 242 in order to perform the processes from step S114 and afterwards.

It is detected in step S113 whether or not the ID measuring switch 242 is turned on. If the ID measuring switch 242 is not turned on (NO in step S113), the copying machine becomes a waiting state in step S113 until the ID measuring switch 242 is turned on. Further, if the ID measuring switch 242 is turned on (YES in step S113), both the switches SW1 and SW2 are switched over to the terminal b in step S114, and then, the program flow proceeds to step S115. After processes of S115, S117 and S118 are carried out in manners similar to those of steps S105, S107 and S108 shown in FIG. 11, both the switches SW1 and SW2 are switched over to the terminal a in step S119, and then, the program flow returns to the original main routine.

Figure 13A:
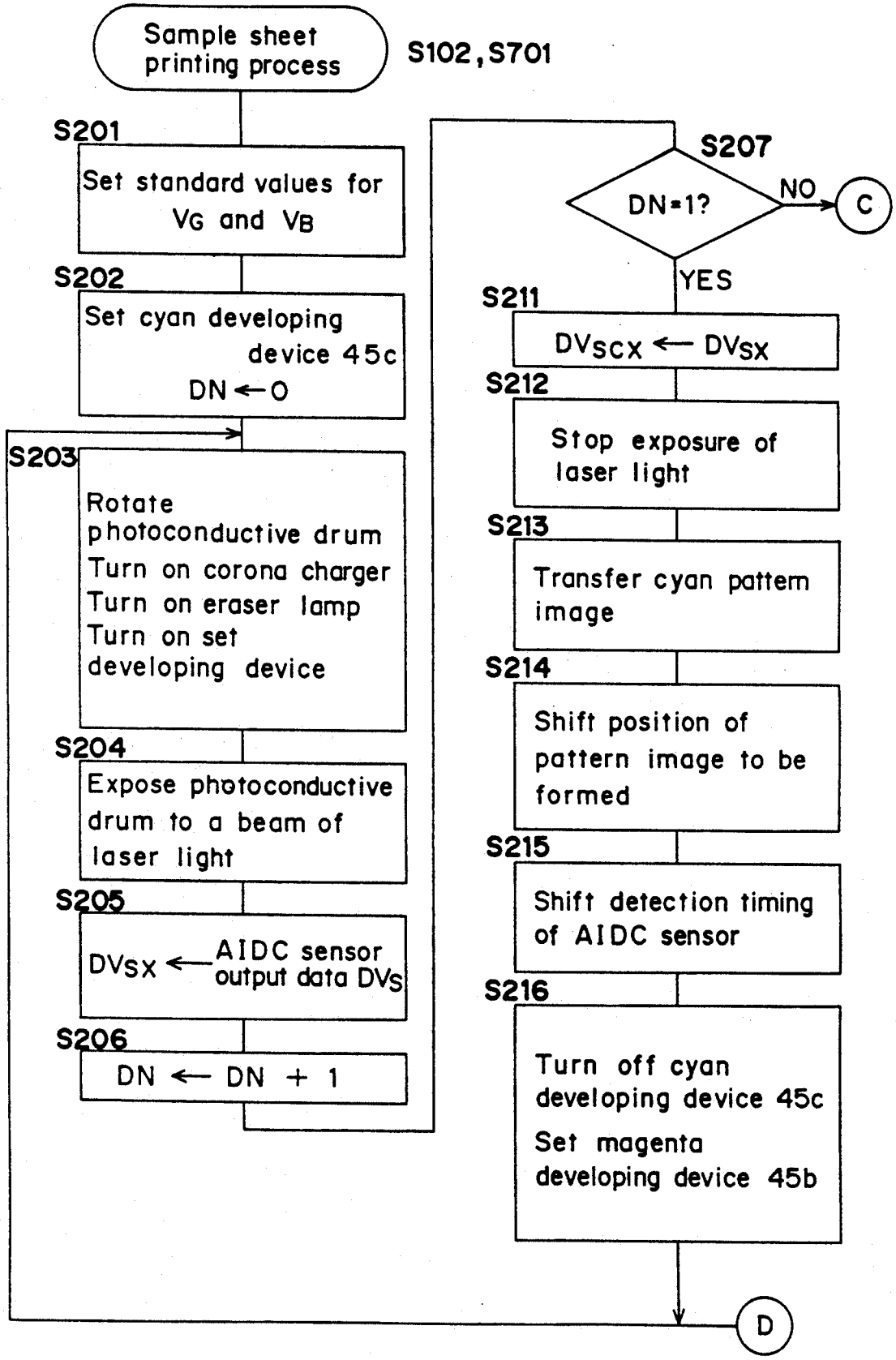
FIGS. 13*a* to 13*c* are flow charts of a sample sheet printing process of a subroutine shown in FIGS. 11 and 18.
Figure 13B:
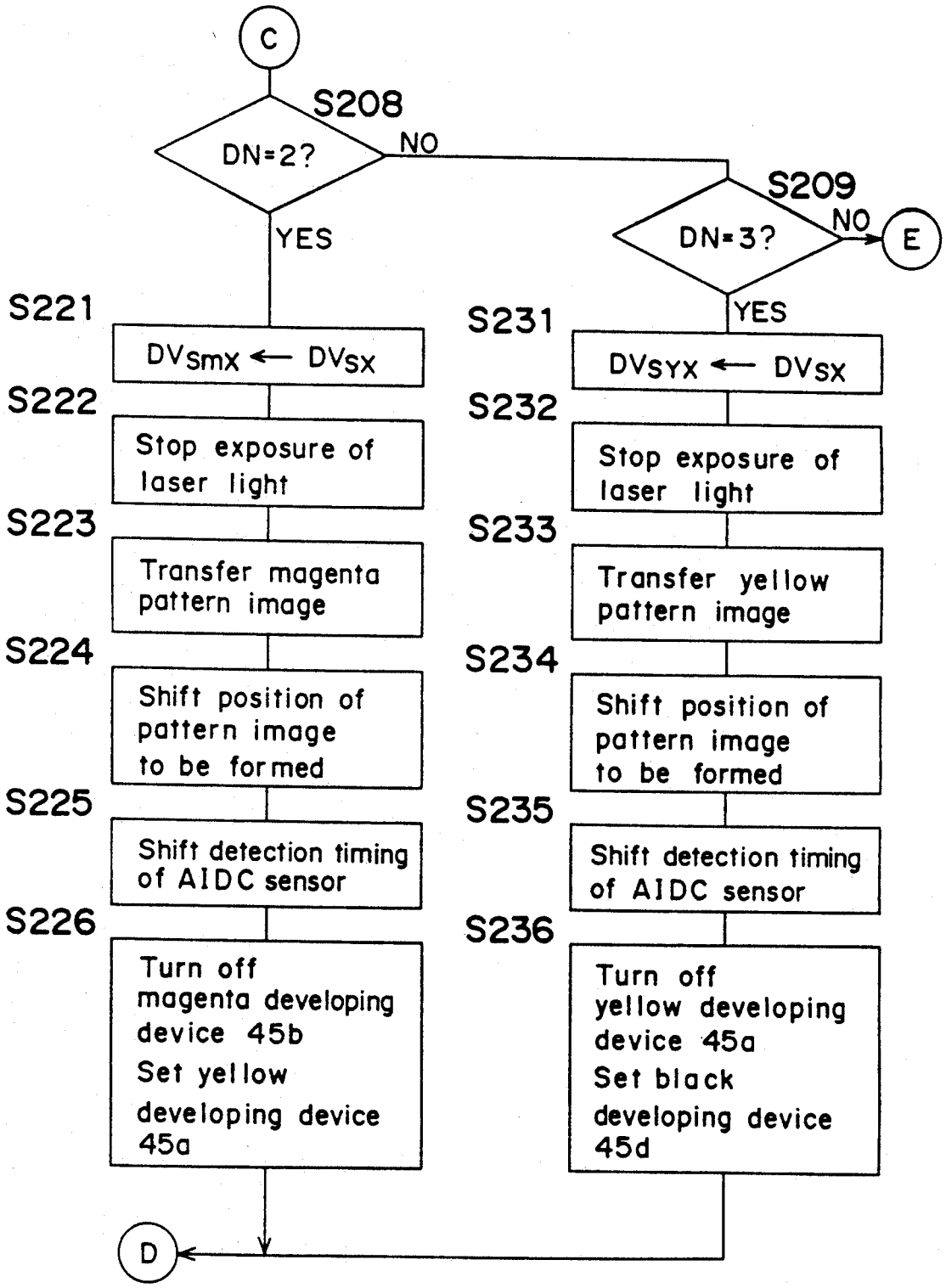
Figure 13C:
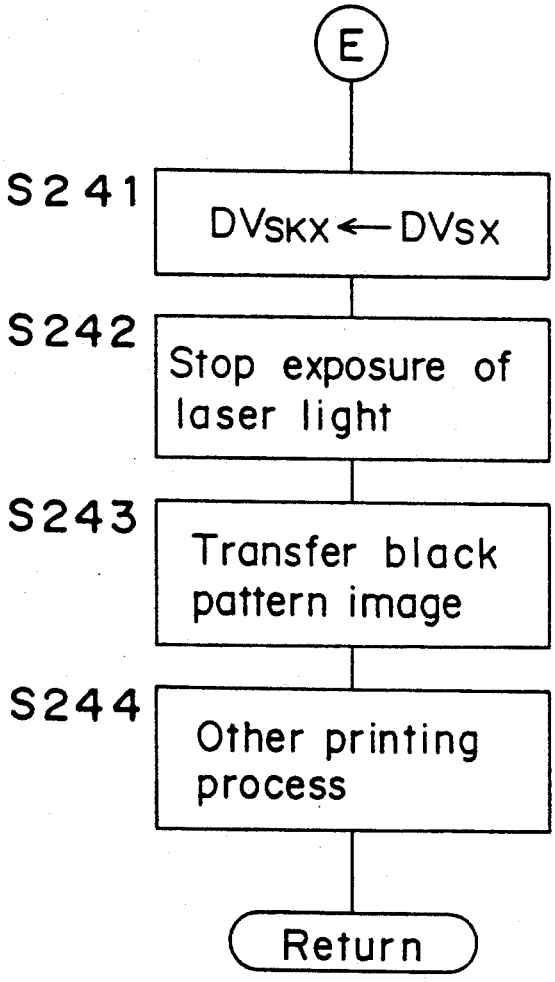
Figure 18:
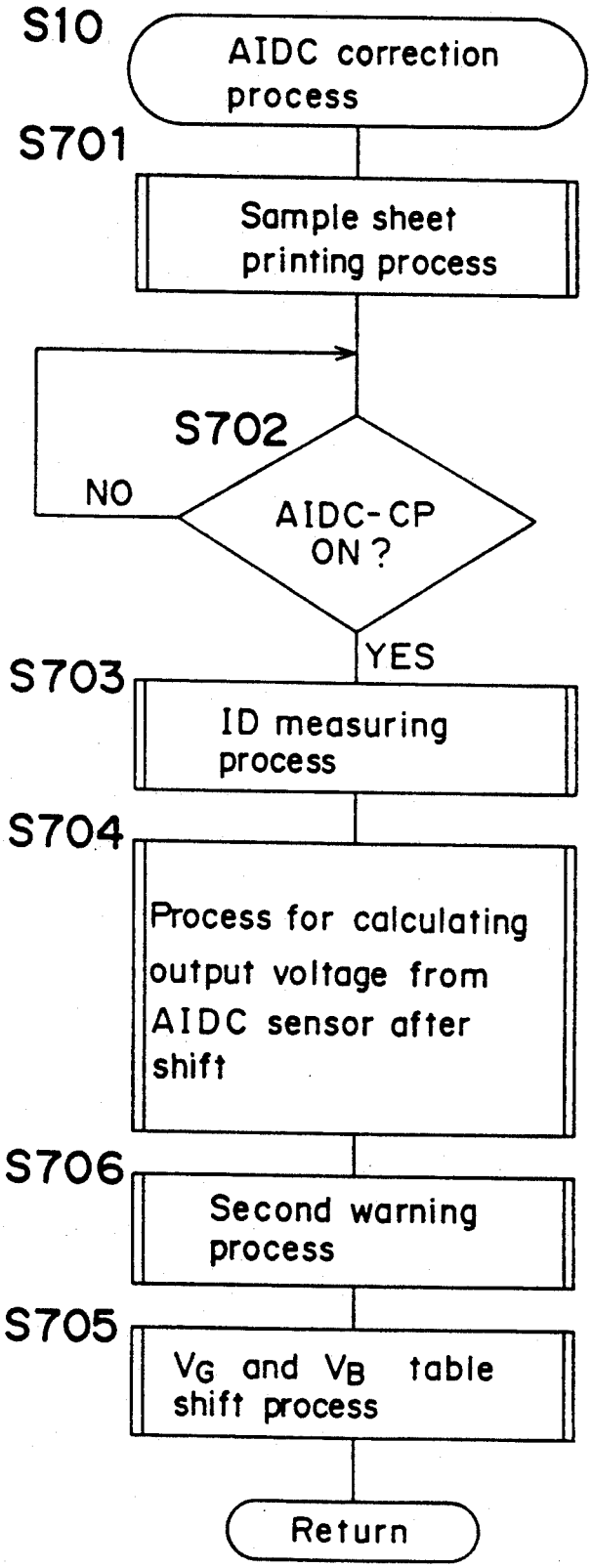
FIG. 18 is a flow chart of an AIDC correction process of a subroutine shown in FIG. 10*b;*

FIGS. 13*a* to 13*c* are flow charts of the sample sheet printing process of the subroutine (steps S102 and S701) shown in FIGS. 11 and 18.

Referring to FIG. 13*a*, after standard values are set respectively as the grid voltage $V_G$ and the developing bias voltage $V_B$ in step S201, the cyan developing device 45*c* is set and a color indicating parameter DN is set to zero in step S202. Thereafter, in step S203, the photoconductive drum 41 is rotated, both of the corona charger 43 and eraser lamp 42 are turned on, and further, the presently set developing device is turned on. Then, the photoconductive drum 41 is exposed to a beam of laser light emitted from the laser diode 221 provided in the print head part 31 in step S204. In step S205, a light amount of a reflected light from a toner image formed on the photoconductive drum 41 by the exposure of a beam of laser light is measured by the AIDC sensor 203, and then, the output data DVs from the AIDC sensor 203 are stored in the RAM 209 as the AIDC data DVsx. Thereafter, the color indicating parameter DN is incremented by one in step S206 so that the added result is made the updated color indicating parameter DN. Further, the program flow goes to step S207.

It is checked in steps S207, S208 and S209 whether the color indicating parameter DN is 1, 2 or 3, respectively.

When the color indicating parameter DN is 1 (YES in step S207), the AIDC data DVsx are stored as the cyan AIDC data DVscx in the RAM 209 in step S211. Thereafter, the exposure of a beam of laser light is stopped in step S212, and then, the cyan pattern image formed on the photoconductive drum 41 is transferred onto a sheet of copying paper in step S213. Thereafter, the position for forming a pattern image is shifted in step S214 so as to form the following magenta pattern image, and then, a detection timing of the AIDC sensor 203 is shifted in step S215 to detect the following magenta pattern image. Further, the cyan developing device 45*c* is turned off in step S216, and also the magenta developing device 45*b* is set. Thereafter, the program flow goes back to step S203.

Referring to FIG. 13*b*, when the color indicating parameter DN is 2 (YES in step S208), the AIDC data DVsx are stored in step S221 as the magenta AIDC data DVsmx in the RAM 209, and then, emission of a beam of laser light is stopped in step S222. Thereafter, the magenta pattern image formed on the photoconductive drum 41 is transferred onto the copying paper in step S223. Then, the position for forming the pattern image is shifted in step S224 so as to form the yellow pattern image, and then, the detection timing of the AIDC sensor 203 is shifted in step S225 to detect the yellow pattern image. Further, the magenta developing device 45b is turned off in step S226, and then, the yellow developing device 45a is set. Thereafter, the program flow returns to step S203.

If the color indicating parameter DN is three (YES in step S209), the AIDC data DVsx are stored as the yellow AIDC data DVsyx in the RAM 209 in step S231, the exposure of a beam of laser light is stopped in step S232, and then, the yellow pattern image formed on the photoconductive drum 41 is transferred onto the copying paper in step S233. Thereafter, the position for forming the pattern image is shifted in step S234 so as to form the black pattern image, and also the detection timing of the AIDC sensor 203 is shifted in step S235 to detect the following black pattern image. Further, the yellow developing device 45a is turned off, and the black developing device 45d is set in step S236. Thereafter, the program flow returns to step S203.

When the color indicating parameter DN is not any one of 1, 2 and 3 (NO in all steps S207, S208 and S209), the AIDC data Dvsx are stored as the black AIDC data Dvskx in the RAM 209 in step S241 shown in FIG. 13c, and then, the exposure of a beam of laser light is stopped in step S242. Thereafter, the black pattern image formed on the photoconductive drum 41 is transferred onto the copying paper in step S243, and then, the other printing processes are performed in step S244. Further, the program flow returns to the original routine.

Figure 14:
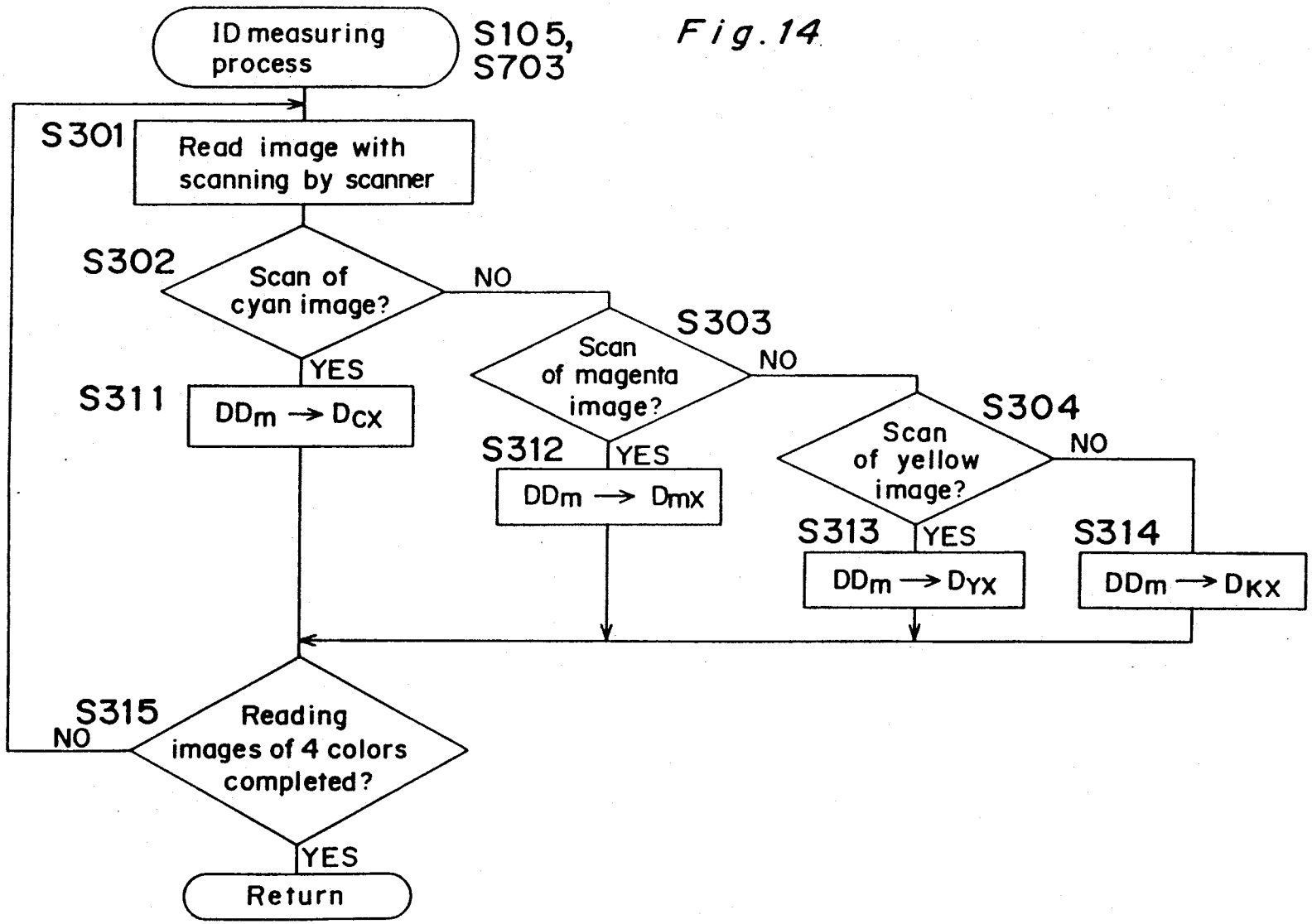
FIG. 14 is a flow chart of an ID measuring process of a subroutine shown in FIGS. 11 and 18.

FIG. 14 is a flow chart of the ID measuring process of the subroutine (steps S105 and S703) shown in FIGS. 11 and 18.

Referring to FIG. 14, the scan operation is performed by the scanner 10 so as to read the original image in step S301, and then, it is judged in steps S302, S303 and S304 whether it is one of the scans for reading images of cyan, magenta and yellow, respectively.

If it is judged to be the scan for reading an image of cyan (YES in step S302), the read density data DDm which are detected by the CCD image sensor 14 and converted by the A/D converter 21 are stored as the cyan read density data Dcx in the RAM 209 in step S311, and then, the program flow goes to step S315. If it is the scan for reading an image of magenta (YES in step S303), the read density data DDm which are detected by the CCD image sensor 14 and converted by the A/D converter 21 are stored as the magenta read density data Dmx in the RAM 209 in step S312, and then, the program flow proceeds to step S315. Further, if it is judged to be the scan for reading an image of yellow (YES in step S304), the read density data DDm which are detected by the CCD image sensor 14 and converted by the A/D converter 21 are stored as the yellow read density data Dyx in the RAM 209 in step S313, and then, the program flow goes to step S315. Moreover, if it is judged that it is not the scan for reading images of cyan, magenta and yellow (NO in all steps S302, S303 and S304), the read density data DDm which are detected by the CCD image sensor 14 and converted by the A/D converter 21 are stored as the black read density data Dkx in the RAM 209 in step S314, and then, the program flow goes to step S315.

In step S315, it is detected whether or not the scans for reading the images of four colors are completed. If it is not detected that the scans for reading the images of four colors are completed (NO in step S315), the program flow moves back to step S301. Otherwise, the program flow returns to the original routine when the scans therefor are completed (YES in step S315).

Figure 15A:
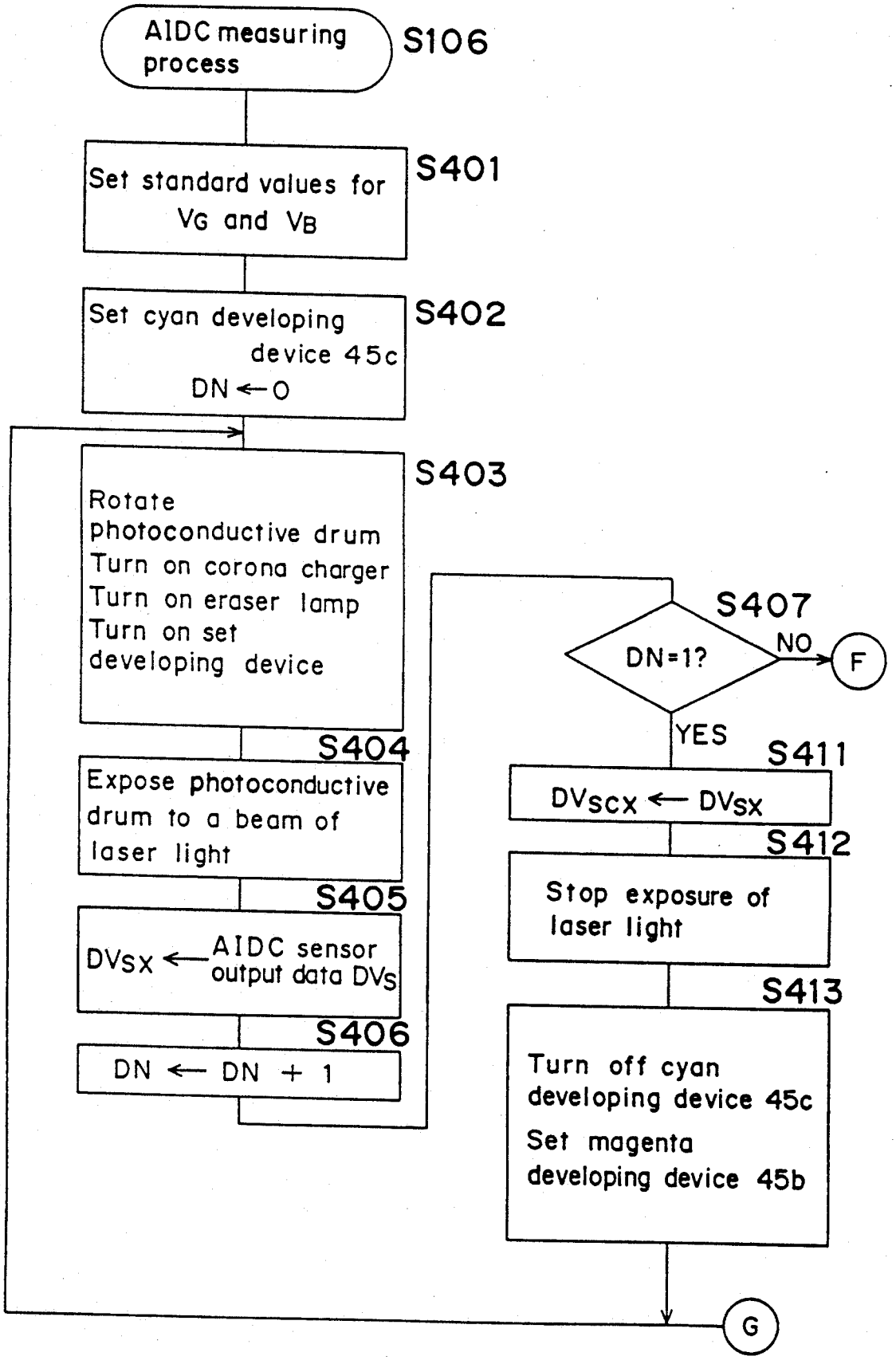
FIGS. 15*a* and 15*b* are flow charts of an AIDC measuring process of a subroutine shown in FIG. 10*a;*
Figure 15B:
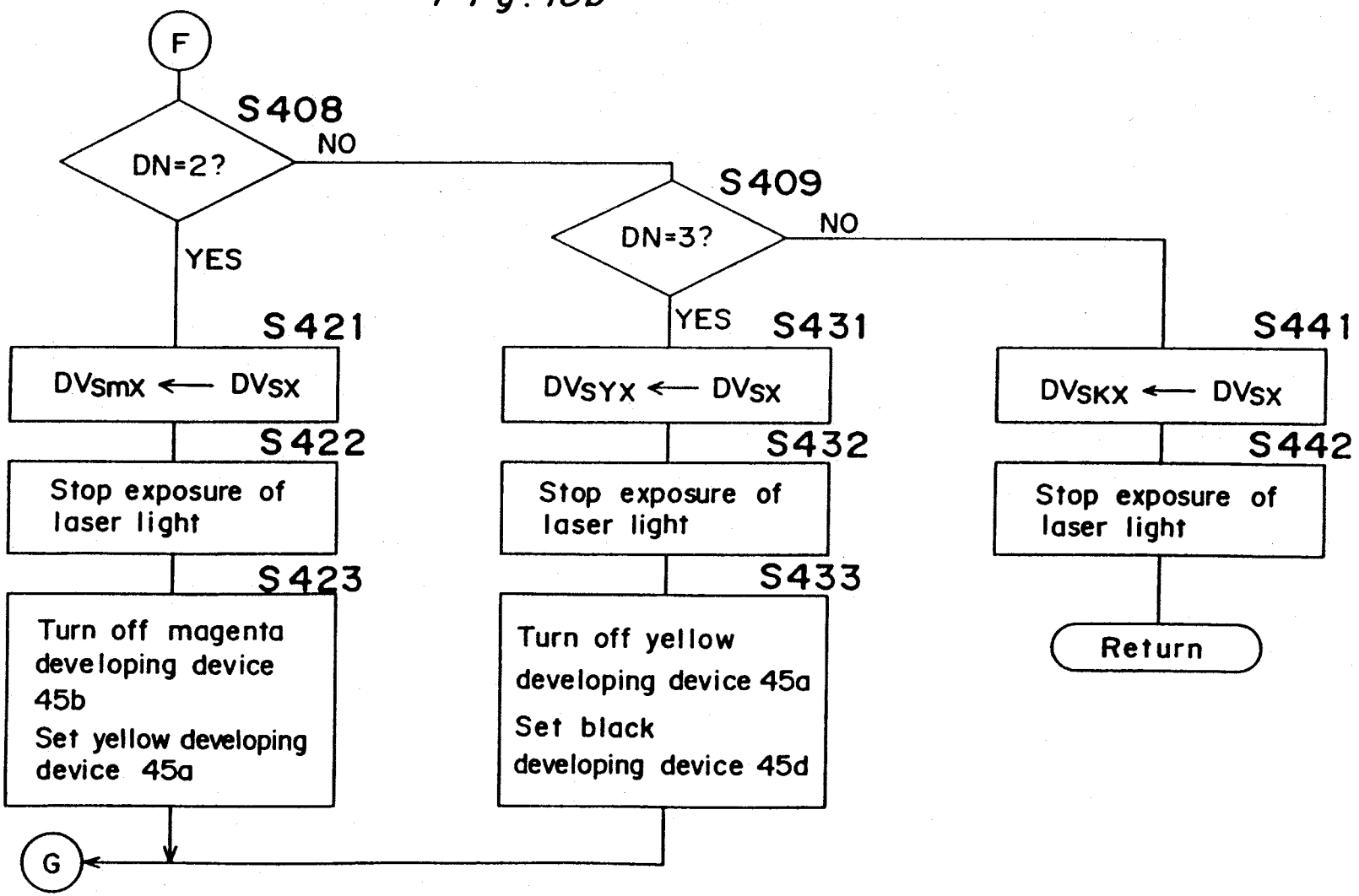

FIGS. 15a and 15b are flow charts of the AIDC measuring process of the subroutine (steps S3) shown in FIG. 10a.

Referring to FIG. 15a, after the standard values of the grid voltage $V_G$ and the developing bias voltage $V_B$ are set in step S401, the cyan developing device 45c is set and also the color indicating parameter DN is set to zero in step S402. The program flow proceeds to step S403, wherein the photoconductive drum 41 is rotated, and both of the corona charger 43 and the eraser lamp 42 are turned on. In the following step S404, the photoconductive drum 41 is exposed to a beam of laser light emitted from the laser diode 221 of the print head part 31. Thereafter, the light amount of the reflected light from the toner image formed on the photoconductive drum 41 by the exposure of a beam of laser light in step S404 is measured by the AIDC sensor 203 in step S405, and then, the output data DVs from the AIDC sensor 203 are stored as the AIDC data DVsx in the RAM 209. Thereafter, the color indicating parameter DN is incremented by one in step S406, so that the adding result is made the updated color indicating parameter DN. Then, the program flow proceeds to step S407.

In steps S407, S408 and S409, it is checked whether the color indicating parameter DN is 1, 2 and 3, respectively.

If the color indicating parameter DN is 1 (YES in step S407), the AIDC data DVsx are stored as the cyan AIDC data DVscx in the RAM 209 in step S411, and then, the exposure of a beam of laser light is stopped in step S412. Thereafter, the cyan developing device 45c is turned off, and also the magenta developing device 45b is set in step S413. Subsequently, the program flow returns to step S403.

Referring to FIG. 15b, when the color indicating parameter DN is 2 (YES in step S408), the AIDC data DVsx are stored as the magenta AIDC data DVsmx in the RAM 209 in step S421, and then, the exposure of a beam of laser light is stopped in step S422. Thereafter, the magenta developing device 45b is turned off and the yellow developing device 45a is set in step S423. Further, the program flow returns to step S403.

When the color indicating parameter DN is 3 (YES in step S409), the AIDC data DVsx are stored as the yellow AIDC data DVsyx in the RAM 209 in step S431, and then, the exposure of a beam of laser light is stopped in step S432. Thereafter, in step S433, the yellow developing device 45a is turned off, and then, the black developing device 45d is set. Further, the program flow moves back to step S403.

When the color indicating parameter DN is not any one of 1, 2, and 3 (NO in all steps S407, S408 and S409), the AIDC data DVsx are stored as the black AIDC data Dvskx in the ram 209 in step S441, and then, the exposure of a beam of laser light is stopped in step S442. Further, the program flow returns to the original routine.

Figure 16:
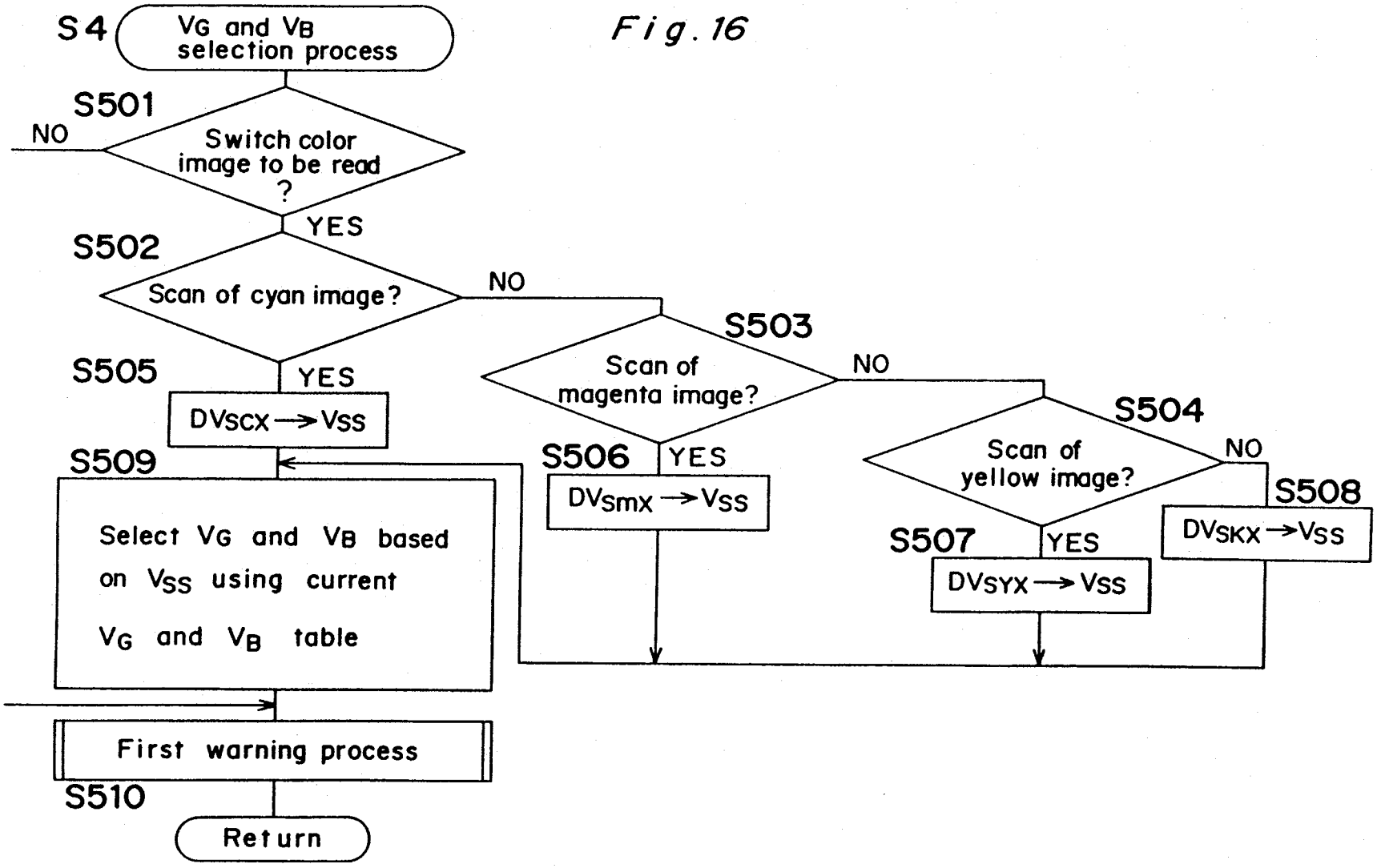
FIG. 16 is a flow chart of a $V_G$ and $V_B$ selection process of a subroutine shown in FIG. 10*a;*

FIG. 16 is a flow chart of the $V_G$ and $V_B$ selection process of the subroutine (step S4) shown in FIG. 10a.

Referring to FIG. 16, it is detected first in step S501 whether or not there has been switched the color of the image to be formed. If the color thereof has been switched (YES in step S501), the program flow advances to step S502. On the other hand, if the color thereof has not been switched (NO in step S501), the program flow returns to step S510. It is checked in steps S502, S503 and S504 whether they are the scans for reading images of cyan, magenta and yellow, respectively.

When it is the scan for reading an image of cyan (YES in step S502), the AIDC data DVscx detected by the AIDC sensor 203 are stored as data Vss in the RAM 209 in step S505, and then, the program flow moves to step S509. Moreover, if it is the scan for reading an image of magenta (YES in step S503), the AIDC data Dvsmx detected by the AIDC sensor 203 are stored as data Vss in the RAM 209 in step S506, and then, the program flow goes to step S509. Further, if it is the scan for reading an image of yellow (YES in step S504), the AIDC data DVsyx detected by the AIDC sensor 203 are stored in step S507 as data Vss in the RAM 209, and then, the program flow goes to step S509. However, if it is not judged to be any one of the scans for reading images of cyan, magenta and yellow (NO in all steps S502, S503 and S504), the AIDC data DVskx detected by the AIDC sensor 203 are stored as data Vss in the RAM 209 in step S508, and then, the program flow goes to step S509.

In step S509, based on the data Vss with respect to the output voltage Vs of the AIDC sensor 203 which are stored in the RAM 209, the grid voltage $V_G$ and the developing bias voltage $V_B$ are selected and set using the $V_G$ and $V_B$ table currently stored in the RAM 209, and then, there is performed in step S510 a first warning process shown in FIGS. 22*a* to 22*d* for warning to the operator that the selected grid voltage $V_G$ and the selected developing bias voltage $V_B$ are the maximum or minimum values, which will be described in detail later. Thereafter, the program flow returns to the main routine.

Figure 17:
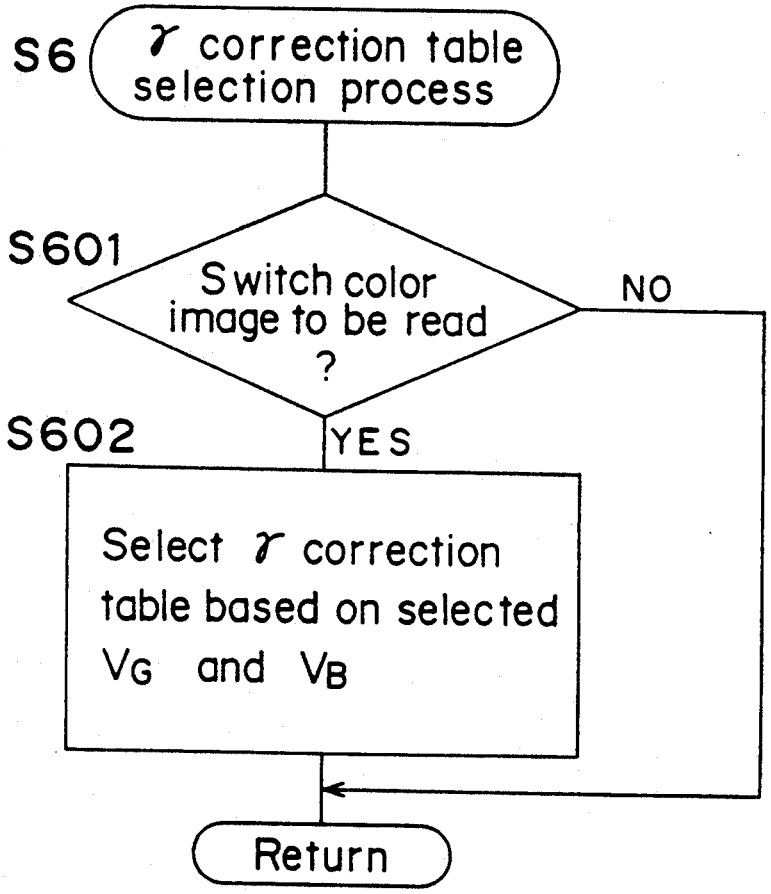
FIG. 17 is a flow chart of a $\gamma$ correction table selection process of a subroutine shown in FIG. 10*a;*

FIG. 17 is a flow chart of the $\gamma$ correction table selection process of the subroutine (step S6) shown in FIG. 10*a*.

Referring to FIG. 17, first of all, it is detected in step S601 whether or not there has been switched the color of the image to be formed. If the color thereof has been switched (YES in step S601), the program flow moves to step S602. Otherwise, the program flow moves back to the original routine. In step S602, a suitable $\gamma$ correction table is selected from the plural $\gamma$ correction tables according to a publicly known method based on the selected grid voltage $V_G$ and the selected developing bias voltage $V_B$, and then, the program flow goes back to the main routine.

FIG. 18 is a flow chart of the AIDC correction process of the subroutine (step S10) shown in FIG. 10*a*.

Referring to FIG. 18, first of all, the above-mentioned sample sheet printing process is performed in step S701, and then, it is checked in step S702 whether or not the AIDC correction switch 241 is turned on. If the AIDC correction switch 241 is not turned on (NO in step S702), the copying machine becomes a waiting state until the AIDC correction switch 241 is turned on. When the AIDC correction switch 242 is turned on (YES in step S702), the ID measuring process is performed in step S703, and then, the program flow moves to step S704.

It becomes necessary to correct the relationship among the output voltage Vs of the AIDC sensor 203, the grid voltage $V_G$ and the developing bias voltage $V_B$ if the relationship thereamong changes due to change in the circumstances. Therefore, there is performed in step S704 a process for calculating the output voltage Vs of the AIDC sensor 203 after the shift of the above-mentioned relationship in order to correct the above-mentioned relationship, and then, there is performed in step S706 a second warning process shown in FIG. 23 for warning the operator that a difference between the output voltage Vsxo of the AIDC sensor 203 after the shift of the above-mentioned relationship and that Vso in the initial state, which will be described in detail later. Thereafter, there is performed the $V_G$ and $V_B$ shift process in step S705 for shifting the grid voltage $V_G$ and the developing bias voltage $V_B$ corresponding to the output voltage Vs of the AIDC sensor 203 in the $V_G$ and $V_B$ table so as to obtain a reproduced image having a constant gradation reproducibility for the original, based on the calculated output voltage Vs of the AIDC sensor 203 after the shift thereof. Thereafter, the program flow returns to the original main routine.

Figure 19A:
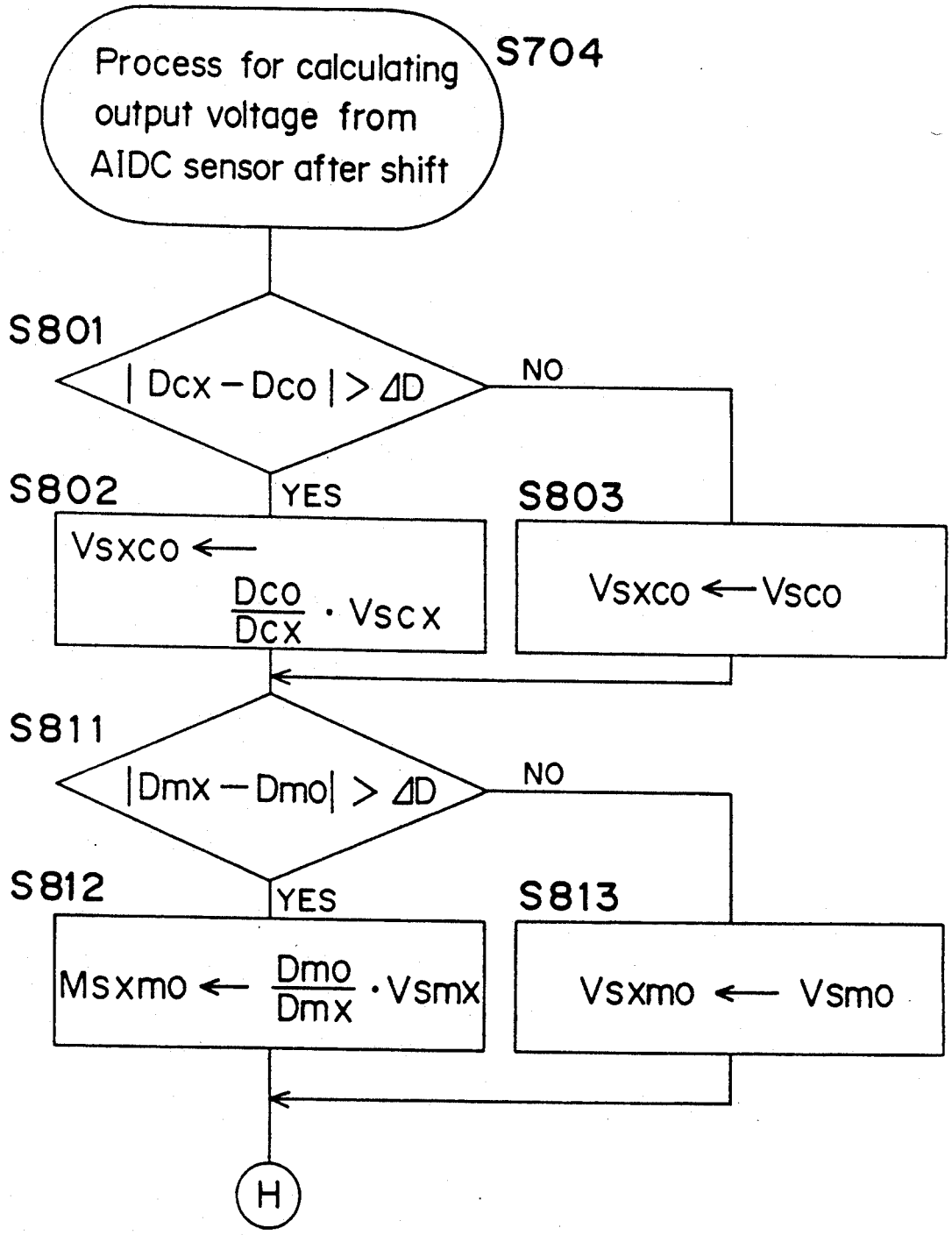
FIGS. 19*a* and 19*b* are flow charts of a process for calculating an output voltage from AIDC sensor after there is shifted a relationship among an output voltage of an AIDC sensor, a grid voltage and a developing bias voltage, of a subroutine shown in FIG. 18.
Figure 19B:
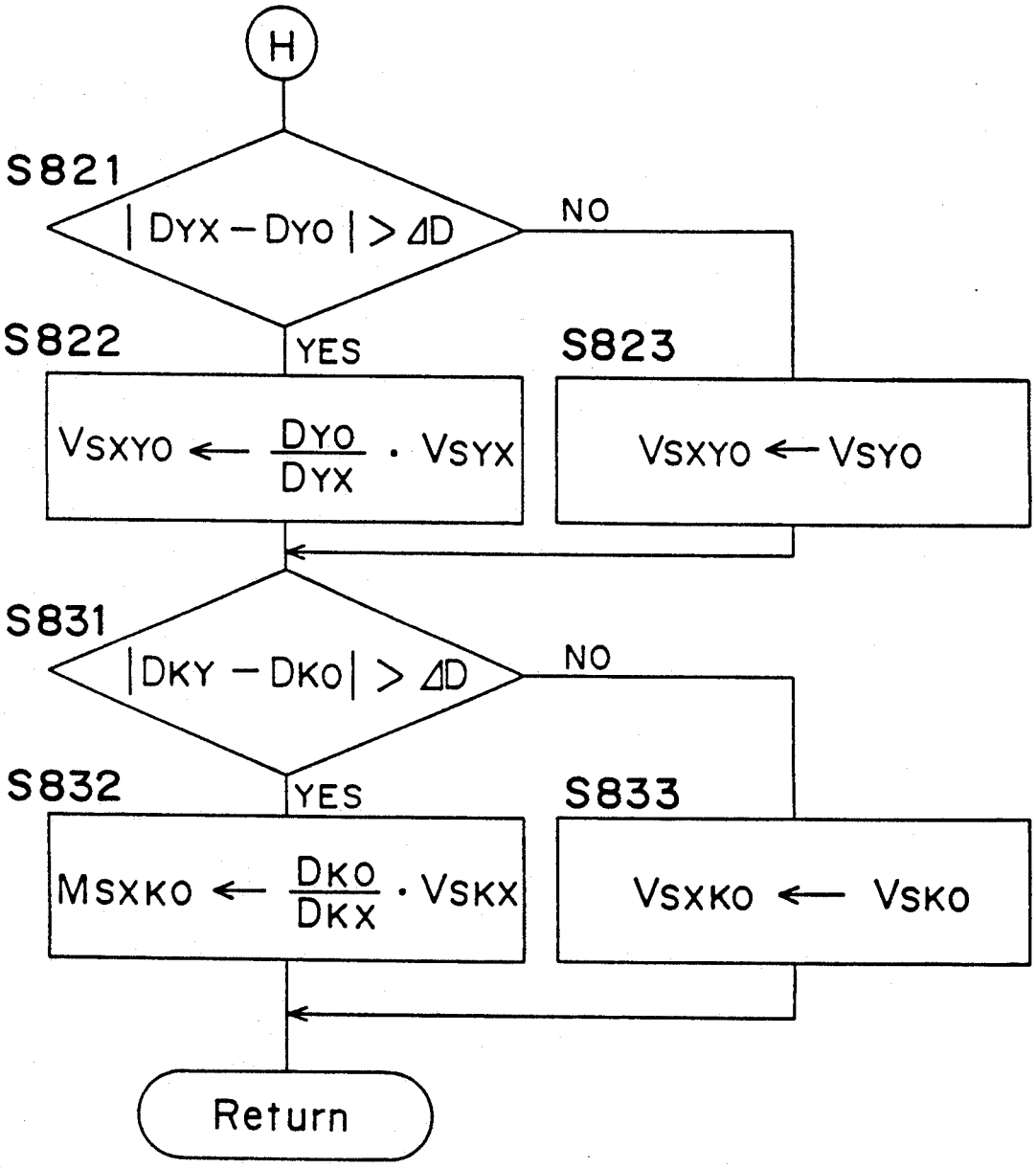

FIGS. 19*a* and 19*b* are flow charts of the process for calculating the output voltage from the AIDC sensor 203 after there is shifted the relationship among the output voltage from the AIDC sensor 203, the grid voltage $V_G$ and the developing bias voltage $V_B$, of the subroutine (step S704) shown in FIG. 18.

Referring to FIG. 19*a*, in step S801, there is calculated an absolute value of a difference between the read density data Dcx of cyan measured in the ID measuring process and the initial read density data Dco stored in the RAM 17 by the subtracter 18, and then, it is judged whether or not the calculated absolute value is larger than a predetermined threshold value $\Delta D$. When the calculated absolute value is larger than the threshold value $\Delta D$ (YES in step S801), the program flow proceeds to step S802. Otherwise, the program flow moves to step S803. In step S802, the right side of the above equation (2a) is calculated, and then, data of the calculated result thereof are stored in the RAM 209 as the output voltage data Vsxco of the AIDC sensor 203 after the shift. Thereafter, the program flow goes to step S811. On the other hand, in step S803, the initial AIDC data Vsco of cyan stored in the RAM 232 are stored in the RAM 209 as the output voltage data Vsxco of the AIDC sensor 203 after the shift, and then, the program flow moves to step S811.

In step S811, an absolute value of a difference between the read density data Dmx of magenta measured in the ID measuring process and the initial read density data Dmo is calculated by the subtracter 18, and then, it is detected whether or not the calculated absolute value thereof is larger than the predetermined value $\Delta D$. If the calculated absolute value thereof is larger than the predetermined threshold value $\Delta D$ (YES in step S811), the program flow goes to step S812. Otherwise, the program flow goes to step S813. In step S812, the right side of the above equation (2b) is calculated, and data of the calculated result are stored in the RAM 209 as the output voltage data Vsxmo of the AIDC sensor 203 after the shift. Thereafter, program flow moves to step S821 of FIG. 19*b*. On the other hand, in step S813, the initial AIDC data Vsmo of magenta stored in the RAM 232 are stored in the RAM 209 as the output voltage data Vsxmo of the AIDC sensor 203 after the shift, and then, the program flow goes to step S821 of FIG. 19*b*.

In the succeeding step S821 of FIG. 19*b*, an absolute value of a difference between the read density data Dyx of yellow measured in the ID measuring process and the initial read density data Dyo stored in the RAM 17 is calculated by the subtracter 18, and then, it is judged whether or not the calculated absolute value thereof is larger than the predetermined threshold value ΔD. If the calculated absolute value thereof is larger than the predetermined threshold value ΔD (YES in step S821), the program flow moves to step S822. On the other hand, if the calculated absolute value thereof is equal to or smaller than the predetermined threshold value ΔD (NO in step S821), the program flow proceeds to step S823. In step S822, the right side of the above equation (2c) is calculated, and then, data of the calculated result thereof are stored in the RAM 209 as the output voltage data Vsxyo of the AIDC sensor after the shift. Thereafter, the program flow goes to step S831. Further, in step S823, the initial AIDC data Vsyo of yellow stored in the RAM 232 are stored in the RAM 209 as the output voltage data Vsxyo of the AIDC sensor 203 after the shift, and then, the program flow subsequently goes to step S831.

In step S831, an absolute value of a difference between the read density data Dkx of black measured in the above ID measuring process and the initial read density data Dko stored in the RAM 17 is calculated by the subtracter 18, and then, it is judged whether or not the calculated absolute value thereof is larger than the predetermined threshold value ΔD. If the calculated absolute value thereof is larger than the predetermined threshold value ΔD (YES in step S831), the program flow goes to step S832. On the other hand, if the calculated absolute value thereof is not larger than the predetermined threshold value ΔD (NO in step S831), the program flow moves to step S833. In step S832, the right side of the above equation (2d) is calculated, and then, data of the calculated result are stored in the RAM 209 as the output voltage data Vsxko of the AIDC sensor 203 after the shift. Thereafter, the program flow returns to the original routine. In step S833, the initial AIDC data Vsko of black stored in the RAM 232 are stored as the output voltage data Vsxko of the AIDC sensor 203 after the shift, and then, the program flow returns to the original routine.

Figure 20:
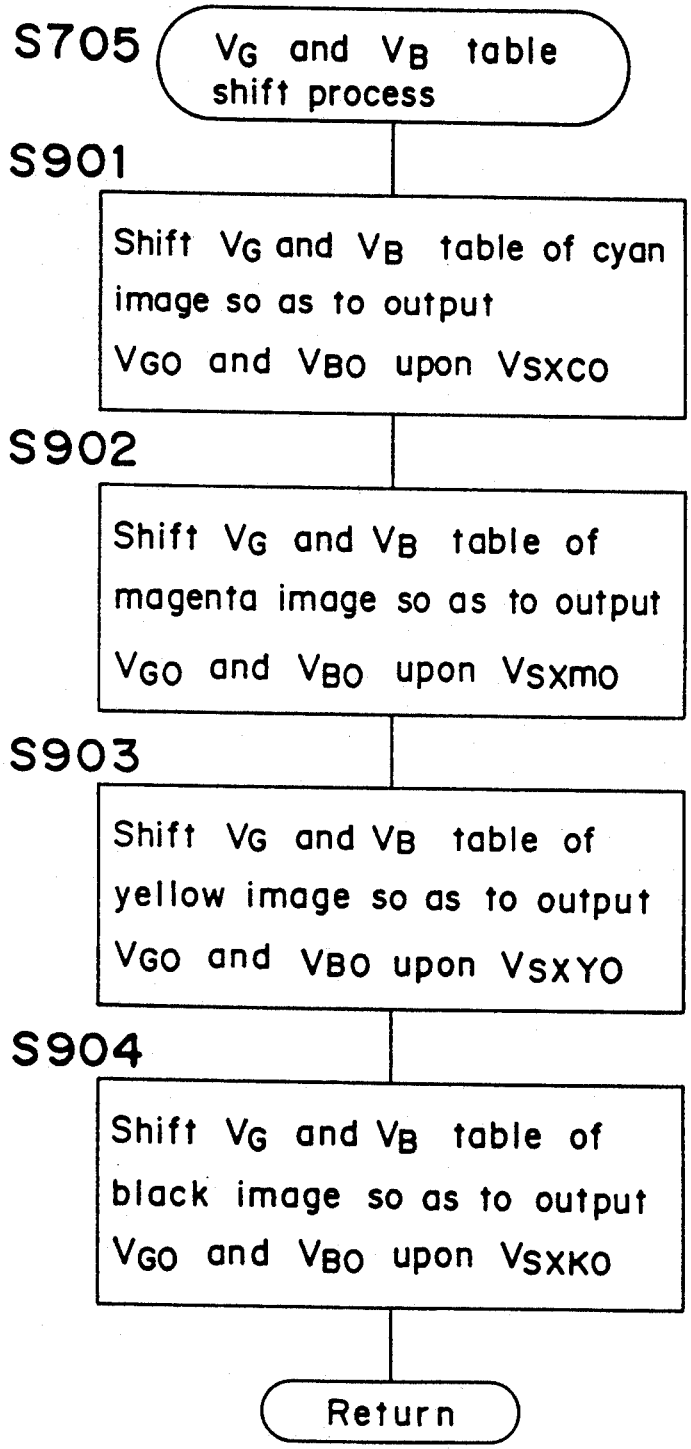
FIG. 20 is a flow chart of a $V_G$ and $V_B$ table shift process of a subroutine shown in FIG. 18.

FIG. 20 is a flow chart of the $V_G$ and $V_B$ table shift process of the subroutine (step S705) shown in FIG. 18.

Referring to FIG. 20, as shown in Table 2, the grid voltage $V_G$ and the developing bias voltage $V_B$ in the $V_G$ and $V_B$ table of cyan are respectively shifted in step S901 so as to be set to the grid voltage $V_G$o in the initial state and the developing bias voltage $V_B$o in the initial state upon the output voltage data Vsxco of the AIDC sensor 203 with respect to the image of cyan after the shift which are calculated in the process shown in FIG. 19*a*. For example, when a table No. 6 in Table 1 for showing the $V_G$ o and $V_B$ table in the initial state is a table selected in the initial state, the initial grid voltage $V_G$o is 650 V and the initial developing bias voltage $V_B$ o is 400 V.

Thereafter, in step S902, as shown in table 2, the grid voltage $V_G$ and the developing bias voltage $V_B$ in the $V_G$ and $V_B$ table of magenta are respectively shifted to be set the grid voltage $V_G$ o in the initial state and the developing bias voltage $V_B$o in the initial state upon the output voltage data Vsxmo of the AIDC sensor 203 with respect to the image of magenta after the shift which are calculated in the process shown in FIG. 19*a*.

Thereafter, in step S903, as shown in Table 2, the grid voltage $V_G$ and the developing bias voltage $V_B$ in the $V_G$ and $V_B$ table of yellow are respectively shifted to be set the grid voltage $V_G$ o in the initial state and the developing bias voltage $V_B$o in the initial state upon the output voltage data Vsxyo of the AIDC sensor 203 with respect to the image of yellow after the shift which are calculated in the process shown in FIG. 19*b*.

In the next step S904, as shown in Table 2, the grid voltage $V_G$ and the developing bias voltage $V_B$ in the $V_G$ and $V_B$ table of black are respectively shifted to be set the grid voltage $V_G$ o in the initial state and the developing bias voltage $V_B$o in the initial state upon the output voltage data Vsxko of the AIDC sensor 203 with respect to the image of black after the shift which are calculated in the process shown in FIG. 19*b*. Thereafter, the program flow returns to the original main routine.

Figure 21:
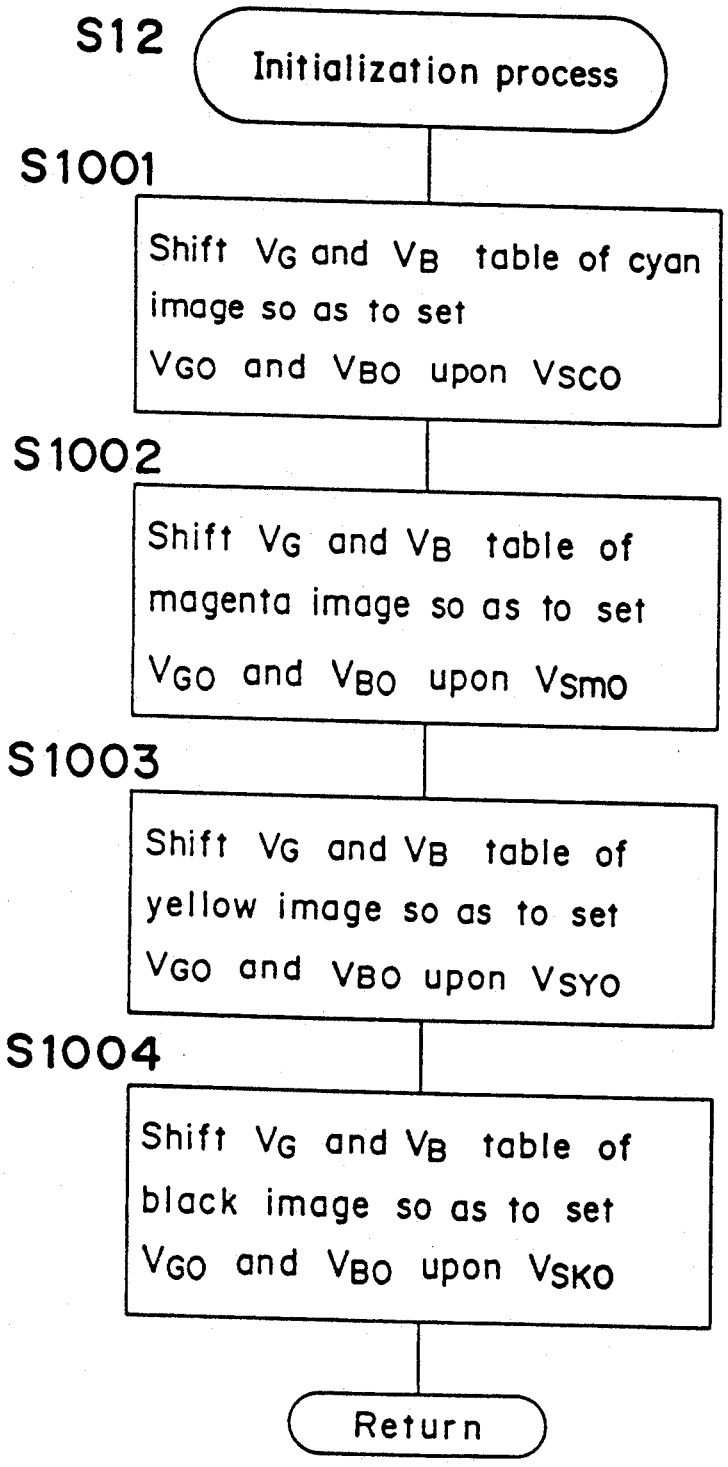
FIG. 21 is a flow chart of an initialization process of a subroutine shown in FIG. 10*b;*

FIG. 21 is a flow chart of the initialization process of the subroutine (step S12) shown in FIG. 10*b*.

In step S1001 of FIG. 21, as shown in Table 1, the grid voltage $V_G$ and the developing bias voltage $V_B$ in the $V_G$ and $V_B$ table of cyan presently stored in the RAM 209 are respectively shifted to be set the grid voltage $V_G$o in the initial state and the developing bias voltage $V_B$o in the initial state upon the initial AIDC data Vsco. Thereafter, in step S1002, as shown in Table 1, the grid voltage $V_G$ and the developing bias voltage $V_B$ in the $V_G$ and $V_B$ table of magenta presently stored in the RAM 209 are respectively shifted to be set the grid voltage $V_G$o in the initial state and the developing bias voltage $V_B$ o in the initial state upon the initial AIDC data Vsmo. Thereafter, in step S1003, as shown in Table 1, the grid voltage $V_G$ and the developing bias voltage $V_B$ in the $V_G$ and $V_B$ table of yellow presently stored in the RAM 209 are respectively shifted to be set the grid voltage $V_G$o in the initial state and the developing bias voltage $V_B$ o in the initial state upon the initial AIDC data Vsyo. Thereafter, in step S1004, as shown in Table 1, the grid voltage $V_G$ and the developing bias voltage $V_B$ in the $V_G$ and $V_B$ table of black presently stored in the RAM 209 are respectively shifted to be set the grid voltage $V_G$o in the initial state and the developing bias voltage $V_B$ o in the initial state upon the initial AIDC data Vsko. Then, the program flow returns to the main routine.

FIGS. 22*a* to 22*d* are flow charts of the first warning process of the subroutine shown in FIG. 16. It is to be noted that the grid voltage $V_G$ and the developing bias voltage $V_B$ to be set are previously determined in the present preferred embodiment, for example, as shown in Tables 1 and 2.

Figure 22A:
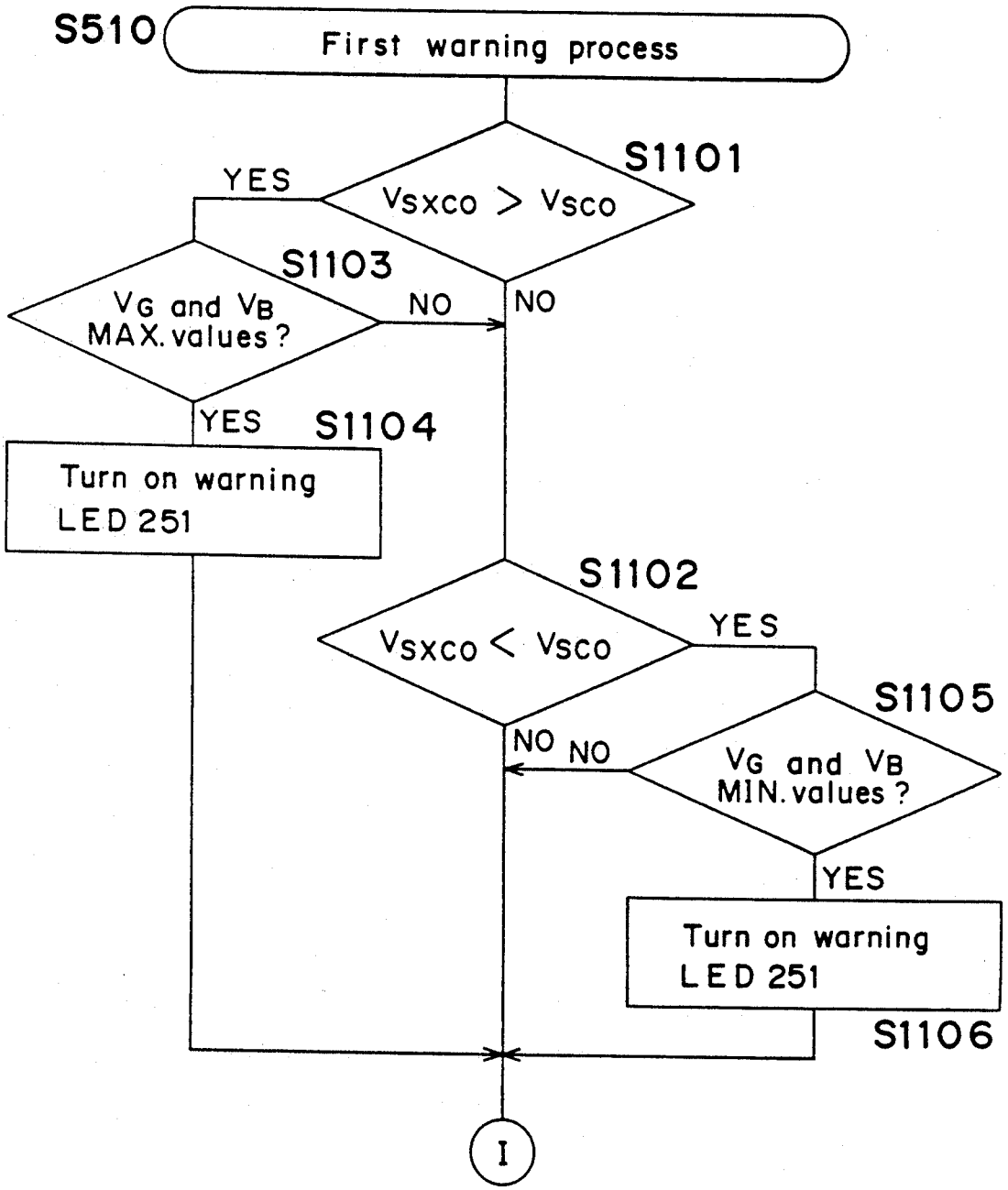
FIGS. 22*a* to 22*d* are flow charts of a first warning process of a subroutine shown in FIG. 16.

Referring to FIG. 22*a*, it is judged in step S1101 whether or not the output voltage Vsxco of the AIDC sensor 203 after the shift of the above-mentioned relationship is larger than the output voltage Vsco thereof in the initial state, upon forming an image of cyan. If the output voltage Vsxco is larger than the output voltage Vsco (YES in step S1101), it is judged in step S1103 whether or not the selected grid voltage $V_G$ and the selected developing bias voltage $V_B$ are the maximum values. If the selected grid voltage $V_G$ and the selected developing bias voltage $V_B$ are the maximum values (YES in step S1103), the grid voltage $V_G$ and the developing bias voltage $V_B$ can not be heightened, and therefore, the warning LED 251 is turned on in step S1104. Thereafter, the program flow goes to step S1111 of FIG. 22*b*. On the other hand, if the output voltage Vsxco is equal to or smaller than the output voltage Vsco (NO in step S1101) or the selected grid voltage $V_G$ and the selected developing bias voltage $V_B$ are not the maximum values (NO in step S1103), the program flow goes to step S1102, and then, it is judged whether or not the output voltage Vsxco is smaller than the output voltage Vsco. If the output voltage Vsxco is smaller than the output voltage Vsco (YES in step S1102), the program flow goes to step S1105, and then, it is judged whether or not the selected grid voltage $V_G$ and the selected developing bias voltage $V_B$ are the minimum values. If the selected grid voltage $V_G$ and the selected developing bias voltage $V_B$ are the minimum values (YES in step S1105), the grid voltage $V_G$ and the developing bias voltage $V_B$ can not be lowered, and therefore, the warning LED 251 is turned on in step S1104. Thereafter, the program flow goes to step S1111 of FIG. 22*b*. Further, if the output voltage Vsxco is not smaller than the output voltage Vsco (NO in step S1102) or the selected grid voltage $V_G$ and the selected developing bias voltage $V_B$ are not the minimum values (NO in step S1105), the program flow goes to step S1111 of FIG. 22*b*.

Figure 22B:
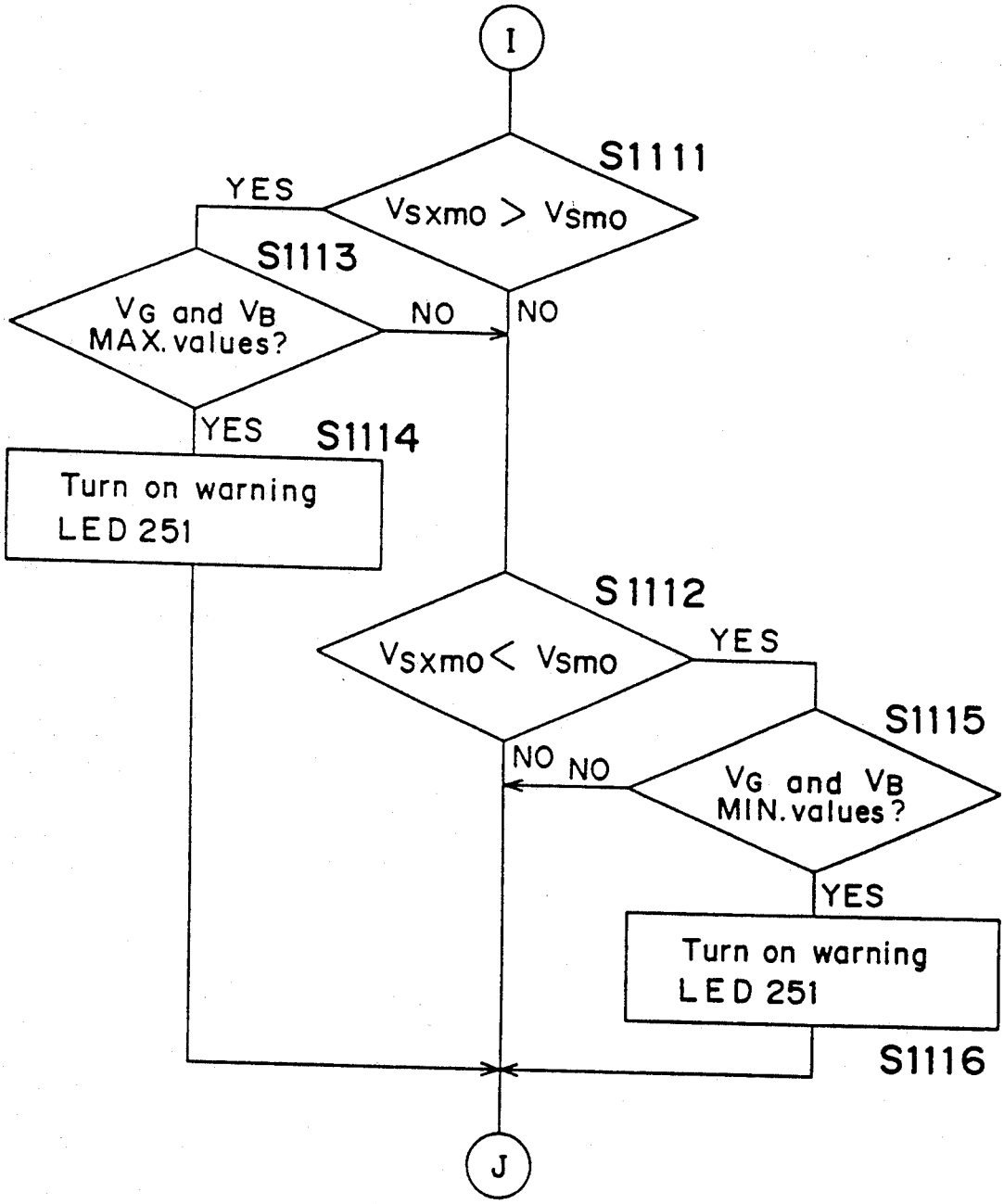
Figure 22C:
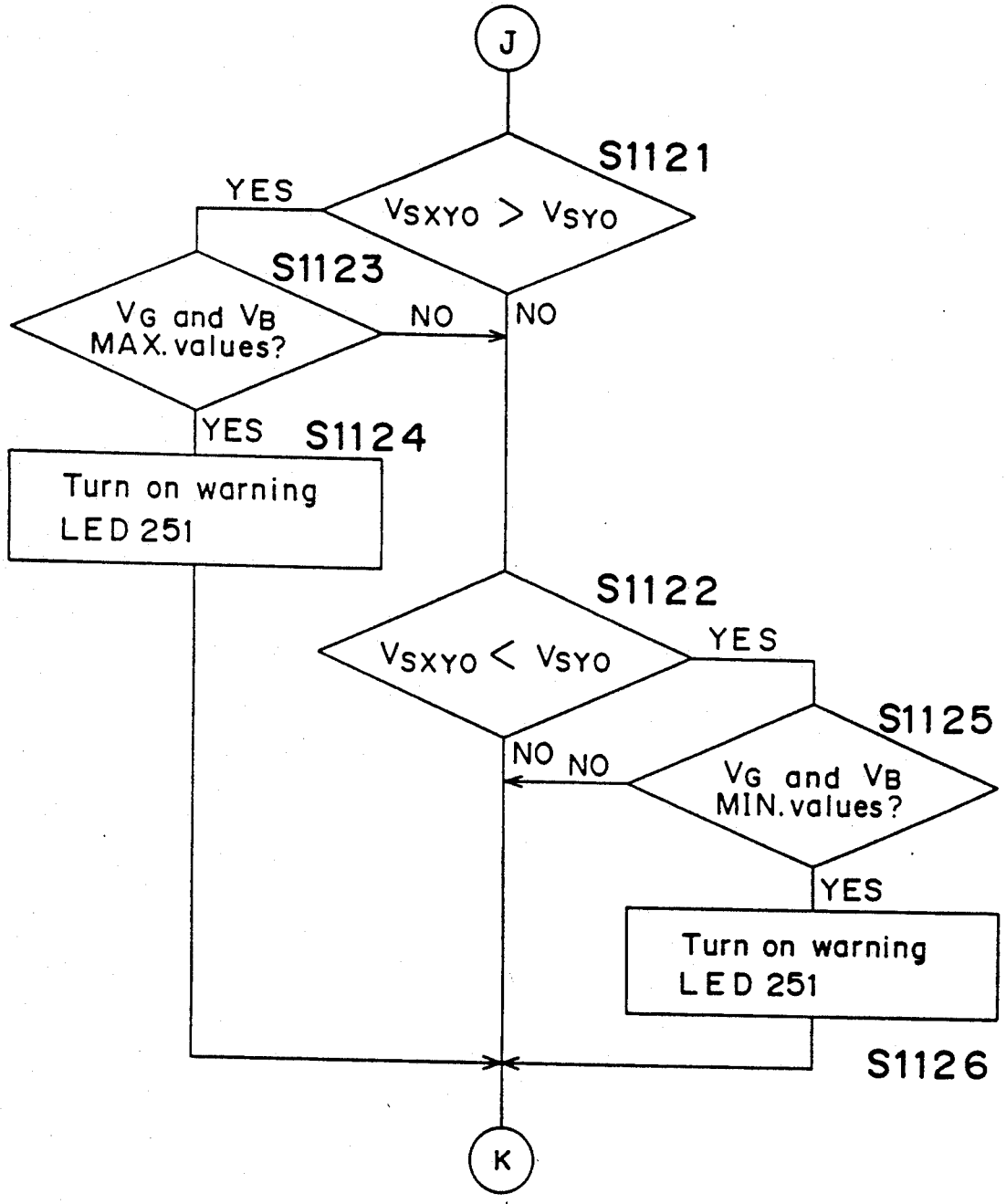

Thereafter, as shown in FIG. 22*b*, first warning processes from step S1111 to S1116 upon forming an image of magenta are performed in manners similar to those of the processes from S1101 to S1106 shown in FIG. 22*a*, and then, the program flow goes to step S1121 of FIG. 22*c*.

Figure 22D:
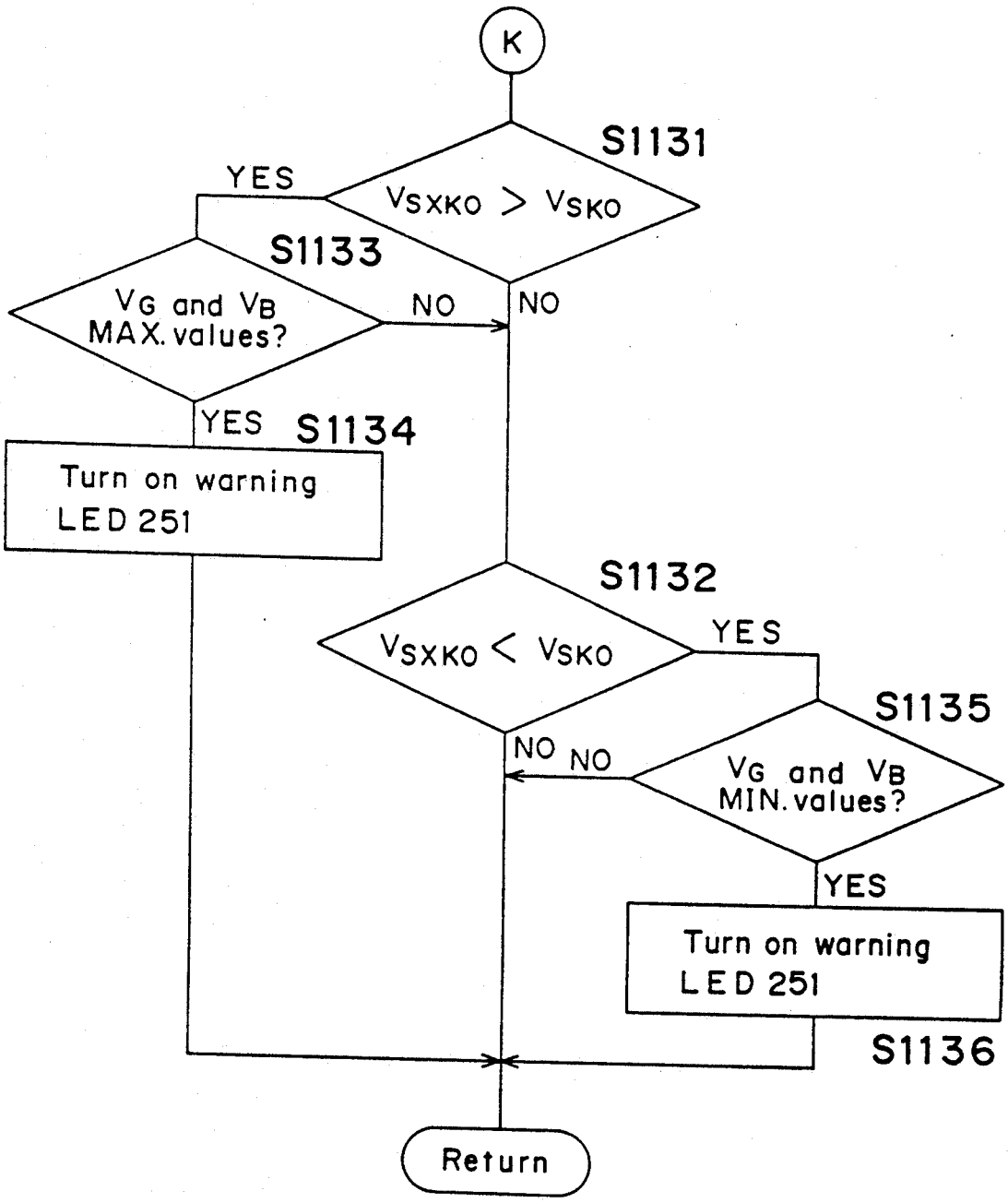

Thereafter, as shown in FIG. 22*c*, first warning processes from step S1121 to S1126 upon forming an image of yellow are performed in manners similar to those of the processes from S1101 to S1106 shown in FIG. 22*a*, and then, the program flow goes to step S1131 of FIG. 22*d*.

Thereafter, as shown in FIG. 22*d*, first warning processes from step S1131 to S1136 upon forming an image of black are performed in manners similar to those of the processes from Sl101 to S1106 shown in FIG. 22*a*, and then, the program flow returns to the original routine.

Figure 23:
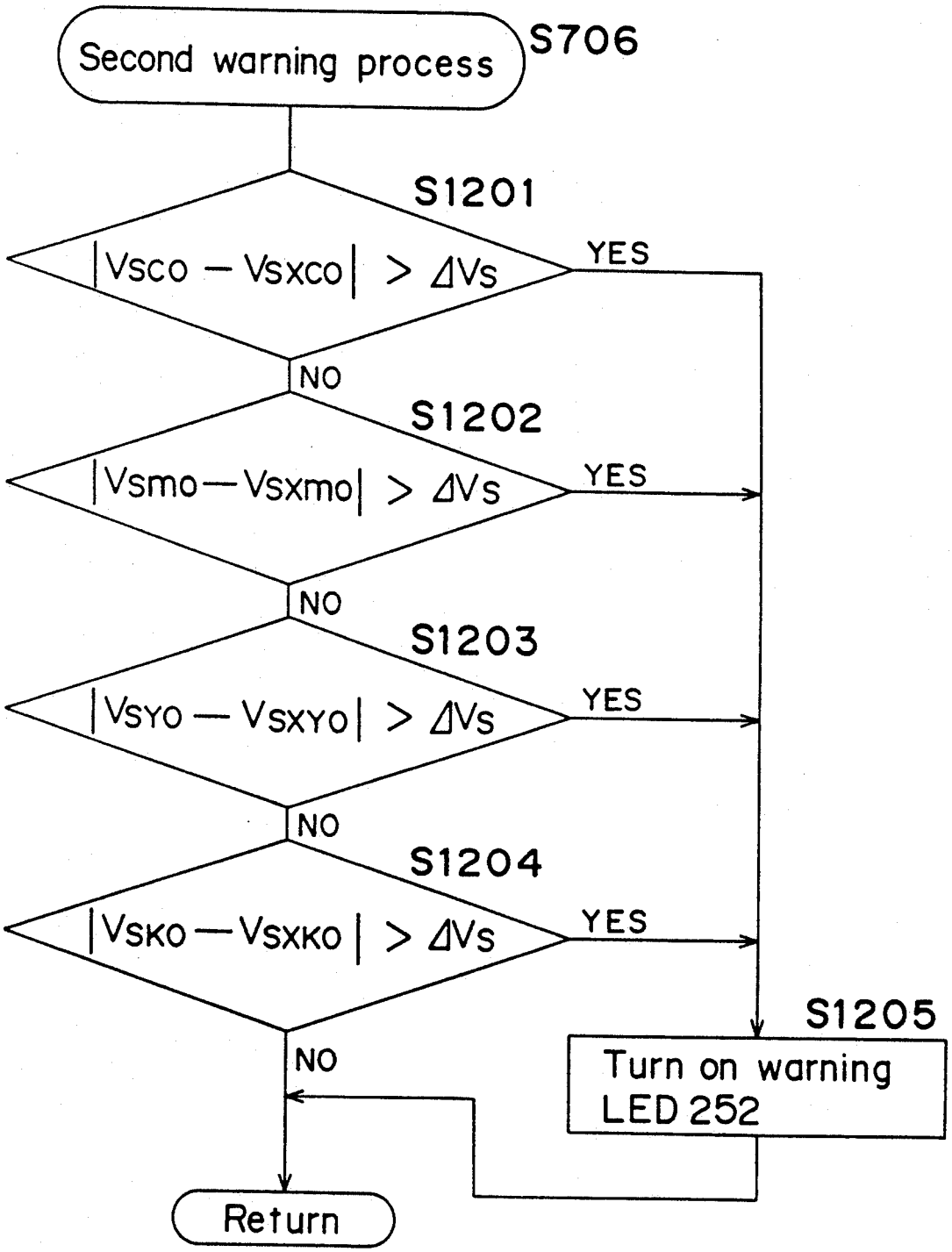
FIG. 23 is a flow chart of a second warning process of a subroutine shown in FIG. 18.

FIG. 23 is a flow chart of the second warning process of the subroutine shown in FIG. 18.

Referring to FIG. 23, it is judged in step S1201 whether or not an absolute value of a difference between the output voltage Vsco of the AIDC sensor 203 after the shift of the above-mentioned relationship and the output voltage Vsxco thereof in the initial state is larger than a predetermined threshold value ΔVs upon forming an image of cyan. If the absolute value thereof is larger than the predetermined threshold value ΔVs (YES in step S1201), it is necessary to increase the shift amount of the output voltage Vs in the table, however, the shift amount thereof is limited in the present preferred embodiment, as described above. Therefore, the program flow goes to step S1205, the warning LED 252 is turned on, and then, the program flow goes back to the original routine. On the other hand, if the absolute value thereof is not larger than the predetermined threshold value ΔVs (NO in step S1201), the program flow goes to step S1202.

Thereafter, it is judged in step S1202 whether or not an absolute value of a difference between the output voltage Vsmo of the AIDC sensor 203 after the shift of the above-mentioned relationship and the output voltage Vsxmo thereof in the initial state is larger than the predetermined threshold value ΔVs upon forming an image of magenta. If the absolute value thereof is larger than the predetermined threshold value ΔVs (YES in step S1202), the program flow goes to step S1205, the warning LED 252 is turned on, and then, the program flow goes back to the original routine. On the other hand, if the absolute value thereof is not larger than the predetermined threshold value ΔVs (NO in step S1202), the program flow goes to step S1203.

Thereafter, it is judged in step S1203 whether or not an absolute value of a difference between the output voltage Vsyo of the AIDC sensor 203 after the shift of the above-mentioned relationship and the output voltage Vsxyo thereof in the initial state is larger than the predetermined threshold value ΔVs upon forming an image of yellow. If the absolute value thereof is larger than the predetermined threshold value ΔVs (YES in step S1203), the program flow goes to step S1205, the warning LED 252 is turned on, and then, the program flow goes back to the original routine. On the other hand, if the absolute value thereof is not larger than the predetermined threshold value ΔVs (NO in step S1203), the program flow goes to step S1204.

Thereafter, it is judged in step S1204 whether or not an absolute value of a difference between the output voltage Vsko of the AIDC sensor 203 after the shift of the above-mentioned relationship and the output voltage Vsxko thereof in the initial state is larger than the predetermined threshold value ΔVs upon forming an image of black. If the absolute value thereof is larger than the predetermined threshold value ΔVs (YES in step S1204), the program flow goes to step S1205, the warning LED 252 is turned on, and then, the program flow goes back to the original routine. On the other hand, if the absolute value thereof is not larger than the predetermined threshold value ΔVs (NO in step S1204), the program flow goes to the original routine, directly.

In the foregoing description of the embodiment, in the case where the characteristic curve 401 in the initial state of the relationship between the output voltage Vs of the AIDC sensor 203 and the image density ID changes to, for example, the characteristic curve 402 as shown in FIG. 7, the grid voltage $V_G$ and the developing bias voltage $V_B$ in the $V_G$ and $V_B$ table are respectively shifted so as to obtain a desirable proper image density. However, the present invention is not limited to this, and the following image density control process may be performed when the characteristic shown in FIG. 7 is shifted from the initial characteristic curve 401.

Figure 8:
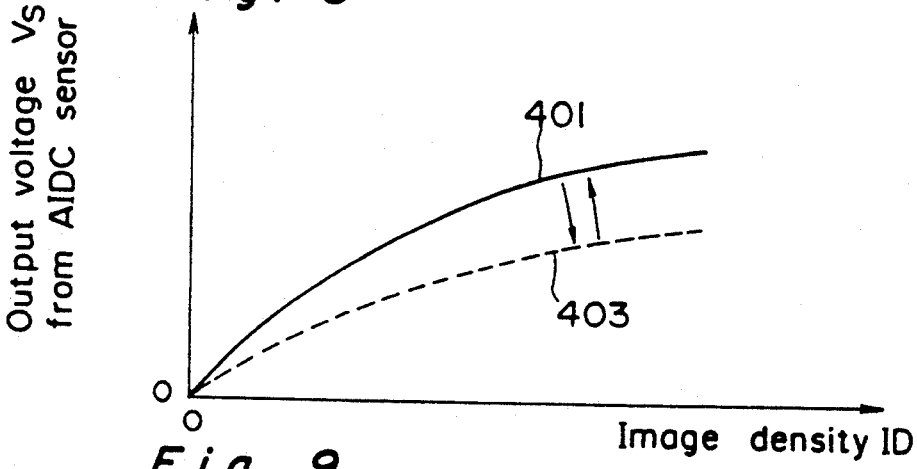
FIGS. 8 and 9 are graphs of relationships between an image density and an output voltage of the AIDC sensor showing a modification of the image density control process performed in the digital full color copying machine shown in FIGS. 1 and 2*a* to 2*c*, respectively.

(a) When a gain of the AIDC sensor 203 is lowered as shown in FIG. 8 and then the characteristic shown in FIG. 7 changes from the initial characteristic curve 401 to the characteristic curve 403, the gain thereof may be increased so as to return to a characteristic curve substantially close to the original initial characteristic curve 401.

(b) When an image density of a printed image of an original is about 0.1 and the printed image has an image density smaller than an original density of the original, the output power of the laser diode 221 may be increased. On the other hand, when the printed image has an image density larger than an original density of the original, the output power of the laser diode 221 may be decreased.

(c) When a printed image of an original has an image density larger or smaller or than an original density of the original, there may be changed the grid voltage $V_G$ and the developing bias voltage $V_B$ which are used when the reference test pattern image is formed. For example, when the image density is approximately 0.3 and the printed image has an image density smaller than an original density of the original, the grid voltage $V_G$ is lowered, for example, from 650 V to 500 V, and also, the developing bias voltage $V_B$ is lowered from 400 V to 250 V. On the other hand, when the printed image has an image density larger than an original density of the original, the grid voltage $V_G$ is heightened, for example, from 650 V to 800 V, and also, the developing bias voltage $V_B$ is heightened from 400 V to 550 V.

(d) When a printed image of an original has an image density smaller or larger than an original density of the original, there may be changed the output light amount of the laser diode 221 when the reference test pattern image is formed on the photoconductive drum 41. For example, if an image density of a printed image of an original is about 0.1 and the printed image has an image density smaller than an original density of the original, the output light amount of the laser diode 221 is lowered, for example, from 110 to 90. On the other hand, if the printed image has an image density larger than an original density of the original, the output light amount of the laser diode 221 is heightened, for example, from 110 to 130.

Figure 9:
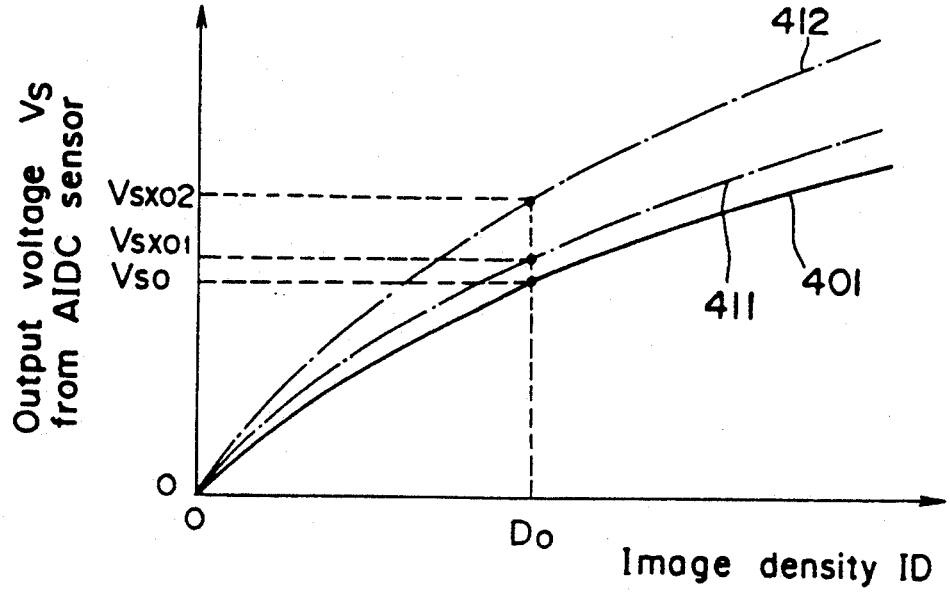

(e) In the case where a shift amount is relatively small when the characteristic for representing the relationship between the output voltage Vs of the AIDC sensor 203 and the image density is shifted, for example, from the initial characteristic curve 401 to a characteristic curve 411 as shown in FIG. 9, the image density control process of the present preferred embodiment is performed. However, in the case where a shift amount is relatively large when the characteristic for representing the relationship between the output voltage Vs of the AIDC sensor 203 and the image density is shifted, for example, from the initial characteristic curve 401 to a characteristic curve 412 as shown in FIG. 9, the following image density control process may be performed.

When a shift amount between the output voltage Vsxo of the AIDC sensor 203 to be shifted and the initial output voltage Vso is equal to or larger than 0.4 V, the temperature and the humidity are detected automatically by the temperature and humidity sensor 205, and the output voltage of the transfer charger 52 is heightened based on the detected temperature and humidity. Thereafter, the AIDC correction process of the present preferred embodiment is performed again.

As described above, according to the present preferred embodiment of the present invention, in an image density control apparatus for performing the image density control process for controlling an image density of a reproduced image based on the output of detection means such as the AIDC sensor 203 for detecting a light amount of a reflected light from a toner image, there can be obtained a reproduced image having a desirable proper image density even if the relationship between the output of the detection means and the image density is shifted from that in the initial state when shipping the image forming apparatus from the factory, the original image can be reproduced with proper image density.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

TABLE 1

| Table No. | Output voltage Vs (V) of AIDC sensor | Grid voltage $V_G$ (V) | Developing bias voltage $V_B$ (V) |
|---|---|---|---|
| 1 | $0.4 < Vs \leqq 0.6$ | 900 | 650 |
| 2 | $0.6 < Vs \leqq 0.8$ | 850 | 600 |
| 3 | $0.8 < Vs \leqq 1.0$ | 800 | 550 |
| 4 | $1.0 < Vs \leqq 1.2$ | 750 | 500 |
| 5 | $1.2 < Vs \leqq 1.4$ | 700 | 450 |
| 6 | $1.4 < Vs \leqq 1.6$ | 650 | 400 |
| 7 | $1.6 < Vs \leqq 1.8$ | 600 | 350 |
| 8 | $1.8 < Vs \leqq 2.0$ | 550 | 300 |
| 9 | $2.0 < Vs \leqq 2.2$ | 500 | 250 |
| 10 | $2.2 < Vs \leqq 2.4$ | 450 | 200 |

TABLE 2

| Table No. | Output voltage Vs (V) of AIDC sensor | Grid voltage $V_G$ (V) | Developing bias voltage $V_B$ (V) |
|---|---|---|---|
| 1 | $0.4 < Vs \leqq 0.6$ | 1000 | 750 |
| 2 | $0.6 < Vs \leqq 0.8$ | 950 | 700 |
| 3 | $0.8 < Vs \leqq 1.0$ | 900 | 650 |
| 4 | $1.0 < Vs \leqq 1.2$ | 850 | 600 |
| 5 | $1.2 < Vs \leqq 1.4$ | 800 | 550 |
| 6 | $1.4 < Vs \leqq 1.6$ | 750 | 500 |
| 7 | $1.6 < Vs \leqq 1.8$ | 700 | 450 |
| 8 | $1.8 < Vs \leqq 2.0$ | 650 | 400 |
| 9 | $2.0 < Vs \leqq 2.2$ | 600 | 350 |
| 10 | $2.2 < Vs \leqq 2.4$ | 550 | 300 |

What is claimed is:

1. An image forming apparatus for forming an image on a sheet of paper, comprising:

an image retaining member;

image forming means for forming a reference toner image on said image retaining member;

first detection means for detecting a density of said reference toner image formed on said image retaining member and outputting first density data for representing the detected density thereof;

transfer means for transferring said reference toner image formed on said image retaining member onto a sheet of paper;

second detection means for detecting a density of said reference toner image transferred on said sheet of paper and outputting second density data for representing the detected density thereof; and adjustment means for automatically adjusting an image density of an image formed on a sheet of paper so as to obtain a predetermined image density by controlling operation conditions of said image forming apparatus based on said first and second density data respectively outputted from said first and second detection means.

2. The apparatus as claimed in claim 1, wherein said second detection means is an image reader for reading an image of an original to be formed on a sheet of paper.

3. The apparatus as claimed in claim 1, wherein said image forming means includes:

a corona charger for electrically charging said image retaining member uniformly with an variable output value thereof;

a developing device for developing an image formed on said image retaining member using toner with a developing bias voltage so as to form a toner image thereon; and a power source for applying a predetermined developing bias voltage, and said adjustment means alters the output value of said corona charger and the developing bias voltage outputted from said power source based on said first and second density data respectively outputted from said first and second detection means.

4. An image forming apparatus for forming an image on a sheet of paper, comprising:

an image retaining member;

image reading means for reading an image of an original to be formed;

image data output means for converting the image of the original read by said image reading means into image data for representing a density of the read image and outputting the converted image data;

latent image forming means for forming an electrostatic latent image on said image retaining member based on the image data outputted from said image data output means;

developing means for developing the electrostatic latent image on said image retaining member with toner so as to form a toner image thereon;

first detection means for detecting a density of said toner image formed on said image retaining member and outputting first density data for representing the detected density thereof;

storage means for storing plural operation conditions of said latent image forming means and said developing means to be set for reproducing an image having a predetermined density, corresponding to the density of the toner image formed on said image retaining member;

reference latent image forming means for forming a reference electrostatic latent image on said image retaining member;

second detection means for detecting a density of a reference toner image after developing the reference electrostatic latent image formed on said image retaining member so as to form the reference toner image thereon by said reference latent image forming means, and outputting second density data for representing the detected density thereof;

adjustment means for selectively executing either one of:

a process of a first image density adjustment mode for reading out desirable operation conditions from said storage means based on the first density data outputted from said first detection means, and controlling said latent image forming means and said developing means to automatically adjust an image density of an image formed on a sheet of paper so as to obtain a predetermined image density, based on the read operation conditions; and a process of a second image density adjustment mode for changing a correspondence relationship between the operation conditions stored in said storage means and the density of the toner image of the first density data outputted from said first detection means into another correspondence relationship therebetween, based on the image data outputted from said image data outputted means and the second density data outputted from said second detection means;

wherein the image of the original read by said image reading means is an image reproduced by transferring the reference toner image formed on said image retaining member onto a sheet of paper.

5. The apparatus as claimed in claim 4, wherein said adjustment means judges whether or not a difference between the image data outputted from said image data output means and predetermined reference image data is larger than a predetermined value, and executes the process of said second image density adjustment mode when judging that the difference therebetween is larger than the predetermined value.

6. The apparatus as claimed in claim 5, wherein, in the process of the second image density adjustment mode, said adjustment means corrects the second density data outputted from said second detection means based on a difference between the image data outputted from said image data output means and the second density data outputted from said second detection means, and alters contents of the operation conditions stored in said storage means based on said corrected second density data.

7. The apparatus as claimed in claim 6, further comprising:

further storage means for storing the second density data in an initial state of said image forming apparatus;

judging means for judging whether or not a difference between the second density data corrected by said adjustment means and the second density data stored in said further storage means is larger than a predetermined value; and warning means for warning an operator when it is judged by said judging means that the difference between the second density data corrected by said adjustment means and the second density data stored in said further storage means is larger than the predetermined value.

8. An image forming apparatus for forming an image on a sheet of paper, comprising:

an image retaining member;

a further image retaining medium different from said image retaining member;

first image forming means for forming a reference toner image having a predetermined density on said image retaining member;

first detection means for detecting a density of said reference toner image formed on said image retaining member and outputting first density data for representing the detected density thereof;

second image forming means for forming a reference toner image having a predetermined density on said further image retaining medium;

second detection means for detecting a density of said reference toner image formed on said further image retaining medium and outputting second density data for representing the detected density thereof; and adjustment means for automatically adjusting an image density of an image formed on a sheet of paper by controlling operation conditions of said image forming apparatus based on said first and second density data respectively outputted from said first and second detection means.

9. An image forming apparatus for forming an image on a sheet of paper, comprising:

an image retaining member;

a further image retraining member different from said image retaining member;

first image forming means for forming a reference toner image having a predetermined density on said image retaining member;

first detection means for detecting a density of said reference toner image formed on said image retaining member and outputting first density data for representing the detected density thereof;

first adjustment means for automatically adjusting operation conditions on said image forming apparatus based on said first density outputted from said first detecting means;

second image forming means for forming a reference toner image having a predetermined density on said further image retaining medium;

second detection means for detecting a density of said reference toner image formed on said further image retaining medium and outputting second density data for representing the detected density thereof; and second adjustment means for automatically adjusting operation conditions of said image forming apparatus based on said first and second density data respectively outputted from said first and second detection means.

* * * * *